US006158513A

United States Patent [19]

Nistor et al.

[11] Patent Number: 6,158,513

[45] Date of Patent: Dec. 12, 2000

[54] MULTIPLE STRING COMPLETION APPARATUS AND METHOD

[75] Inventors: Radu Nicolae Nistor, Edmonton; Laurier E. Comeau; Ian Gillis, both of Leduc; Timothy Edward LaGrange, Edmonton, all of Canada; Benji Smith, Spring, Tex.; James Fehr, Sherwood Park, Canada

[73] Assignee: Halliburton Energy Services, Inc., Houston, Tex.

[21] Appl. No.: 09/129,792

[22] Filed: Aug. 6, 1998

[30] Foreign Application Priority Data

Jul. 31, 1998 [CA] Canada ..... 2244451

[51] Int. Cl.[7] ..... E21B 7/08

[52] U.S. Cl. ..... 166/313; 166/50; 166/117.6

[58] Field of Search ..... 166/50, 117.5, 166/117.6, 313, 384

[56] References Cited

U.S. PATENT DOCUMENTS

| | | | |
|---|---|---|---|
| 4,415,205 | 11/1983 | Rehm et al. . | |
| 5,311,936 | 5/1994 | McNair et al. | 166/50 |
| 5,318,121 | 6/1994 | Brockman et al. | 166/313 |
| 5,325,924 | 7/1994 | Bangert et al. | 166/313 |
| 5,330,007 | 7/1994 | Collins et al. | 166/313 |
| 5,454,430 | 10/1995 | Kennedy et al. | 166/313 |
| 5,458,199 | 10/1995 | Collins et al. | 166/313 |
| 5,499,680 | 3/1996 | Walter et al. | 166/377 |
| 5,533,573 | 7/1996 | Jordan, Jr. et al. | 166/313 |
| 5,655,602 | 8/1997 | Collins et al. | 166/313 |
| 5,685,373 | 11/1997 | Collins et al. | 166/313 |
| 5,845,710 | 12/1998 | Longbottom et al. | 166/313 |
| 5,944,109 | 8/1999 | Longbottom | 166/313 |

FOREIGN PATENT DOCUMENTS

| | | |
|---|---|---|
| 0859124 | 8/1998 | European Pat. Off. . |
| 2330159 | 4/1999 | United Kingdom . |

OTHER PUBLICATIONS

Sperry–Sun Drilling Services Inc., catalogue entitled "Sourcebook," 1996, pp. 10–13 ("Drilling Services") and 57–62 ("Multilateral Drilling/Completion Systems").

*Primary Examiner*—William Neuder
*Attorney, Agent, or Firm*—Terrence N. Kuharchuk; William Shull; Michael D. McCully

[57] ABSTRACT

An apparatus and method for directing a first and a second object into a primary and a secondary borehole respectively from a main borehole communicating therewith at a borehole junction. The apparatus includes a deflector for positioning at the borehole junction to direct the first and second objects into the primary and secondary boreholes. A retainer holds the objects relative to each other such that when the first object is aligned to be directed into the primary borehole, the second object is aligned to be directed into the secondary borehole. A retainer orienting mechanism orients the retainer relative to the borehole junction so that the objects are aligned to be directed into the boreholes. The method includes positioning the deflector at the borehole junction and inserting the objects and the retainer into the main borehole. The retainer is oriented relative to the borehole junction so that the objects are aligned to be directed into their respective boreholes. The objects are then directed into the boreholes by bringing them into contact with the deflector.

36 Claims, 10 Drawing Sheets

MULTIPLE STRING COMPLETION APPARATUS AND METHOD

TECHNICAL FIELD

The present invention relates to an apparatus and a method for directing a first object into a primary borehole from a main borehole at a borehole junction and directing a second object into a secondary borehole from the main borehole at the borehole junction. More particularly, the apparatus and method may be used for concurrently directing the first object and the second object into the primary and secondary boreholes respectively.

BACKGROUND OF THE INVENTION

Current drilling technology, including directional drilling technology, permits the drilling of conventional vertical boreholes which are substantially perpendicular to the ground surface, as well as deviated or non-vertical boreholes. Directional drilling technology also allows for branch, lateral or secondary boreholes to be drilled laterally from a main or primary borehole. Lateral boreholes are often drilled and produced through a gap in the casing of the main borehole. This gap typically comprises a window cut or milled in a section of the existing casing string. The lateral borehole tends to extend laterally from the main borehole to a desired location within the formation. A main borehole including more than one lateral borehole is typically referred to as a multilateral well.

Industry attention has increasingly become more focused upon multilateral wells both with respect to new drilling operations and the reworking of existing boreholes, including remedial and stimulation work (such as Steam Assisted Gravity Drainage applications). As a result, more attention has become focused upon the economics of, and difficulties associated with, the completion and production of multilateral wells. For instance, with respect to the installation of two or more production tubing strings within the multilateral well, particular applications may require the independent production of the main and lateral boreholes to the surface, while other applications may preferably commingle the production to allow the main and lateral boreholes to be produced simultaneously. Further, when installing the tubing strings, the number of necessary trips downhole is preferably minimized in order to increase or maximize the cost effectiveness or profitability of the multilateral well. Finally, the installation of the tubing strings is preferably accomplished in a manner permitting access to the boreholes so that a selected one of the boreholes may be re-entered as desired.

U.S. Pat. No. 5,311,936 issued May 17, 1994 to McNair et. al., U.S. Pat. No. 5,318,121 issued Jun. 7, 1994 to Brockman et. al. and U.S. Pat. No. 5,325,924 issued Jul. 5, 1994 to Bangert et. al. are all directed at various devices and methods for sealing the junction between a lateral and vertical well, for re-entering selected lateral wells to perform completion work, additional work or remedial and stimulation work and for isolating a lateral well from other lateral wells to permit separate production from the lateral well without commingling the production fluids.

More particularly, McNair, Brockman and Bangert all describe the selective re-entry into either the vertical or lateral well by various objects, such as production tubing or tools. Specifically, in each case, the devices and methods described are aimed at selectively permitting the passage of the object through either a main (vertical) borehole or a first branch (lateral) borehole.

For instance, in one embodiment of McNair, Brockman and Bangert, a first coiled tubing conduit is run into the lateral well. The first coiled tubing conduit has a head which is sized and dimensioned such that it will not enter the vertical well but will instead be diverted into the lateral well by a whipstock. Similarly, a second coiled tubing conduit may be separately run into the vertical well. The second coiled tubing conduit has a head which is sized and dimensioned such that it will not enter the lateral well, but may be run into the vertical well through a bore in the whipstock. The first and second coiled tubing conduits are run into their respective wells in two separate steps or two separate trips downhole. There is no further specific discussion regarding the manner in which the first and second coiled tubing conduits are run into the wells.

In a further embodiment of McNair, Brockman and Bangert, a liner may be run into a lateral well using a specialized sidetrack mandrel. The sidetrack mandrel terminates at a housing which may swivel into alignment with the lateral well. Further, the housing includes a laterally extended section which retains a tubing. The tubing is normally stored within the housing for extension into the lateral well. After the sidetrack mandrel is positioned within the vertical well adjacent the lateral well, the tubing is extended through the housing. Upon extension of the tubing, the head of the tubing contacts a whipstock within the vertical well and is thereby diverted into the lateral. There is no specific discussion with respect to the placement or running of tubing within the vertical well when using the sidetrack mandrel.

Alternately, where zone isolation is desired, a modified side pocket mandrel may be used in place of the sidetrack mandrel. The modified side pocket mandrel includes a housing and a dual packer assembly. The housing includes a separate running string which has a pair of shoulders which act as a stop between a sealed position and a non-sealed position. After the modified side pocket mandrel is positioned within the vertical well adjacent the lateral well, the running string is extended through the housing and moved from its non-sealed to its sealed position. Upon extension from the housing, the head of the running string contacts a whipstock and is diverted into the lateral well. Once again, there is no specific discussion with respect to the placement or running of tubing within the vertical well when using the modified side pocket mandrel. However, the dual packer assembly does permit the use of discrete production tubing from the lateral and the vertical wells.

In a still further embodiment of McNair, Brockman and Bangert, a dual completion head is lowered into the vertical well adjacent the lateral well. The dual completion head has an upper deflecting surface and a longitudinal bore. First, a first tubing string may be stung from the surface through the longitudinal bore of the dual completion head. Second, a second tubing string may also be stung from the surface and deflected by the upper deflecting surface of the dual completion head into the lateral well. The first and second tubing strings are run into their respective wells in two separate steps or two separate trips downhole. There is no further specific discussion regarding the manner in which the first and second tubing strings are run into the wells.

U.S. Pat. No. 5,330,007 issued Jul. 19, 1994 to Collins et. al., U.S. Pat. No. 5,458,199 issued Oct. 17, 1995 to Collins et. al., U.S. Pat. No. 5,655,602 issued Aug. 12, 1997 to Collins et. al. and U.S. Pat. No. 5,685,373 issued Nov. 11, 1997 to Collins et. al. are all related to a template, and a process utilizing the template, for drilling and completing multilateral wells.

The template comprises a body having a first end face, a second end face and a plurality of axially extending divergent bores which extend through the body in intersection with the end faces. The template is secured to a first casing, which extends from the surface to a predetermined depth beneath the surface, or is located at or near the ground surface. A first subterranean borehole is drilled through one of the bores in the template and a first length of production casing is secured to the template such that it extends into the first borehole. Similarly, further subterranean boreholes may be drilled through the further bores in the template and further lengths of production casing may be secured to the template such that the casing extends into its respective borehole.

In addition, a generally tubular riser, which is releasably secured to an orienting cam, may be inserted into the plurality of bores in the template. The riser is automatically aligned with one of the bores through the template and is released from the cam. The riser permits the drill string and the casing to pass through a selected bore in the template and into the desired subterranean borehole. Once the boreholes have been drilled and cased, the riser is withdrawn and production casings may be sequentially secured to the casings or bores. As well, conventional production tubing may be inserted into the casings. However, the patents do not include any specific discussion regarding the manner in which the production tubing is run into the boreholes.

As a result, there remains a need in the industry for an improved apparatus and method for the installation of at least two objects, preferably tubing strings, within a borehole. Further, there is a need for an apparatus and a method for concurrently installing a tubing string within each of a primary borehole and at least one secondary borehole. More particularly, there is a need for an apparatus and a method which hold the tubing strings relative to each other and orient the tubing strings relative to the primary and secondary boreholes such that the tubing strings may be directed or installed therein. Preferably, the apparatus and method install the tubing strings in a manner permitting either the production of the primary and secondary boreholes separately or in a commingled production.

SUMMARY OF THE INVENTION

The present invention relates to an apparatus and a method for installing at least two objects, preferably tubing strings, within a borehole. Further, the invention relates to an apparatus and a method for concurrently installing or directing a tubing string into each of a primary borehole and at least one secondary borehole. More particularly, the apparatus and method preferably hold the tubing strings relative to each other and orient the tubing strings relative to the primary and secondary boreholes such that the tubing strings may be installed or directed therein. As well, the apparatus and the method preferably permit the tubing strings to be installed in a manner permitting either the production of the primary and secondary boreholes separately or in a commingled production, as desired.

Further, the apparatus and method preferably allow for both the concurrent running of the tubing strings into the boreholes and the substantially concurrent landing and sealing of the tubing strings in the primary and secondary boreholes. As well, the running, landing and sealing of the tubing strings in the boreholes is preferably performed in a single trip downhole. Finally, the apparatus also preferably permits the selective re-entry of the primary and secondary boreholes with further production tools as necessary.

In a first aspect of the invention, in a borehole comprising a main borehole, a primary borehole, a secondary borehole and a borehole junction, wherein the main borehole communicates with both the primary borehole and the secondary borehole at the borehole junction, the invention is comprised of an apparatus for use in directing a first object into the primary borehole from the main borehole and directing a second object into the secondary borehole from the main borehole, the apparatus comprising:

(a) a deflector for positioning in the borehole at the borehole junction in order to direct the second object into the secondary borehole from the main borehole and in order to facilitate the direction of the first object into the primary borehole;

(b) a retainer for inserting into the main borehole to hold the first object and the second object relative to each other such that when the first object is aligned to be directed into the primary borehole the second object is also aligned to be directed into the secondary borehole; and (c) a retainer orienting mechanism for orienting the retainer relative to the borehole junction so that the first object is aligned to be directed into the first borehole and the second object is aligned to be directed into the secondary borehole.

In the first aspect, the first object and the second object may be comprised of any tool or other equipment desired or required to be run into the primary and secondary boreholes respectively. However, preferably, the first object is a first tubing string and the second object is a second tubing string.

Further, in the first aspect, the deflector may be comprised of any conventional deflector, such as a whipstock or diverter mandrel, capable of deflecting or directing the second object into the secondary borehole from the main borehole and facilitating the direction of the first object into the primary borehole from the main borehole when the deflector is positioned in the borehole at the borehole junction. However, preferably, the deflector defines a deflector conduit extending therethrough to facilitate communication between the main borehole and the primary borehole when the deflector is positioned in the borehole at the borehole junction.

As well, the deflector conduit preferably comprises a deflector seat for engaging the first tubing string when it is directed into the primary borehole. The first tubing string may engage the deflector seat in any manner. However, the first tubing string preferably engages the deflector seat in a manner facilitating the movement of fluids through the deflector and the primary borehole. In addition, the first tubing string preferably engages the deflector seat in a manner to provide a sealed connection between the first tubing string and the deflector conduit. Thus, at least one of the deflector seat and the first tubing string is preferably comprised of a seal assembly for providing a seal therebetween. The seal assembly may be comprised of any conventional seal or sealing structure.

The deflector is further comprised of an upper end and a lower end. The lower end of the deflector may comprise a deflector extension for engaging a primary borehole seat associated with the primary borehole, wherein the deflector conduit extends from the upper end of the deflector to the lower end of the deflector through the deflector extension. The deflector extension may engage the primary borehole seat in any manner. However, the deflector extension preferably engages the primary borehole seat in a manner facilitating the movement of fluids through the deflector and the primary borehole. In addition, the deflector extension preferably engages the primary borehole seat in a manner to provide a sealed connection between the deflector and the primary borehole. Thus, at least one of the deflector extension and the primary borehole seat is preferably comprised of a seal assembly for providing a seal therebetween. The seal assembly may be comprised of any conventional seal or sealing structure. For instance, the seal assembly may be comprised of one or a combination of seals, packers, slips, liners or cementing.

The apparatus may further be comprised of a deflector orienting mechanism associated with the deflector for orienting the deflector relative to the borehole junction so that the second tubing string may be directed into the secondary borehole. Any conventional orienting mechanism or apparatus capable of orienting the deflector in the borehole relative to the borehole junction may be used. For instance, the deflector orienting mechanism may be comprised of an orienting latch assembly.

The retainer orienting mechanism may also be comprised of any conventional orienting mechanism or apparatus capable of orienting the retainer in the borehole relative to the borehole junction. For instance, the retainer orienting mechanism may also be comprised of an orienting latch assembly. However, preferably, the retainer orienting mechanism is comprised of the upper end of the deflector.

In a preferred embodiment of the apparatus, the retainer orienting mechanism is further comprised of a tubing carrier for inserting into the main borehole to hold at least one of the first tubing string and the second tubing string such that orientation of the tubing carrier relative to the deflector causes orientation of the retainer relative to the deflector. Further, the apparatus may further comprise a first surface on the upper end of the deflector and a second surface on the tubing carrier which is complementary to the first surface on the deflector so that the retainer may be oriented relative to the deflector by engagement of the first surface with the second surface. In the preferred embodiment, the first surface is a first orienting muleshoe and the second surface is a second orienting muleshoe.

Further, in the preferred embodiment of the apparatus, the tubing carrier is preferably capable of permitting longitudinal movement of the first tubing string and the second tubing string relative to the tubing carrier so that the first tubing string and the second tubing string may be directed into the primary borehole and the secondary borehole respectively when the first surface on the deflector is engaged with the second surface on the tubing carrier. The tubing carrier may be further comprised of a shearable fastener for attaching at least one of the first tubing string and the second tubing string to the tubing carrier so that the tubing carrier is capable of permitting longitudinal movement of the first tubing string and the second tubing string relative to the tubing carrier upon shearing of the shearable fastener.

The apparatus may be further comprised of a manifold for inserting in the main borehole to combine the first tubing string and the second tubing string into a third tubing string. Any conventional manifold capable of combining the first and second tubing strings into the third tubing string may be used. However, preferably, the manifold is comprised of a lower end for connecting with the first tubing string and the second tubing string and an upper end for connecting with the third tubing string, wherein the manifold defines a manifold junction for facilitating communication of the third tubing string with both the first tubing string and the second tubing string.

Finally, the retainer may be comprised of any conventional mechanism, device or apparatus which may be inserted into the main borehole and which is capable of holding the first object and the second object relative to each other such that when the first object is aligned to be directed into the primary borehole, the second object is also aligned to be directed into the secondary borehole. For instance, the retainer may be comprised of a dual bore packer or the manifold described above. Further, the retainer may be comprised of the tubing carrier so that the tubing carrier holds the first tubing string and the second tubing string relative to each other such that when the first tubing string is aligned to be directed into the primary borehole the second tubing string is also aligned to be directed into the secondary borehole.

In an alternate embodiment of the apparatus, the retainer orienting mechanism is also comprised of the upper end of the deflector. The upper end of the deflector defines a primary borehole orifice which communicates with the deflector conduit and a secondary borehole orifice which communicates with the secondary borehole, wherein the size of the primary borehole orifice is different than the size of the secondary borehole orifice. In this case, the retainer orienting mechanism is comprised of the primary borehole orifice and the secondary borehole orifice.

Further, in the alternate embodiment, the first tubing string comprises a lower end for directing into the primary borehole, the second tubing string comprises a lower end for directing into the secondary borehole, the secondary borehole orifice is larger in size than the primary borehole orifice and the lower end of the second tubing string is sized to fit within the secondary borehole orifice but not to fit within the primary borehole orifice.

Any means, mechanism, device or structure of the second tubing string may be used such that the lower end of the second tubing string is sized to fit within the secondary borehole orifice and not within the primary borehole orifice. For instance, the diameter of the second tubing string may permit the second tubing string to enter only the secondary borehole orifice.

As well, a constriction may be associated with the secondary borehole and the lower end of the second tubing string may be further comprised of a detachable expansion. In this instance, the lower end of the second tubing string and the expansion are sized such that the lower end of the tubing string will fit within the secondary borehole orifice with the expansion attached to it, but the lower end of the second tubing string will fit within the constriction only with the expansion detached from it, wherein the expansion is detachable from the lower end of the second tubing string as the second tubing string is directed into the secondary borehole.

The constriction may be associated with the secondary borehole in any manner and may be comprised of any device, apparatus or mechanism capable of providing the necessary constriction. For instance, the deflector may define the constriction between the secondary borehole orifice and the secondary borehole. Thus, the constriction is comprised of a portion of the deflector. However, preferably, a secondary borehole seat is associated with the secondary borehole and the constriction is comprised of the secondary borehole seat. Further, the expansion may be detachable from the lower end of the second tubing string in any manner and by any device, apparatus or mechanism capable of detaching the expansion as the second tubing string is directed into the secondary borehole. For instance, a shear pin or other shearable or releasable element may detachably connect the expansion with the second tubing string.

Further, the upper end of the deflector may further comprise an orienting surface whereby the lower end of the second tubing string is directed toward the secondary borehole orifice when the lower end of the second tubing string is lowered into engagement with the upper end of the deflector.

The alternate embodiment of the apparatus may also be further comprised of the manifold, as described above, for inserting in the main borehole to combine the first tubing string and the second tubing string into a third tubing string.

Finally, in the alternate embodiment of the apparatus, the retainer may similarly be comprised of any conventional mechanism, device or apparatus which may be inserted into the main borehole and which is capable of holding the first object and the second object relative to each other such that when the first object is aligned to be directed into the primary borehole, the second object is also aligned to be directed into the secondary borehole. For instance, the retainer may be comprised of a dual bore packer or the manifold described above.

The apparatus of the within invention is preferably removable from the borehole. The apparatus may be removed by any conventional apparatus or technique for removing such equipment from a borehole.

In a second aspect of the invention, in a borehole comprising a main borehole, a primary borehole, a secondary borehole and a borehole junction, wherein the main borehole communicates with both the primary borehole and the secondary borehole at the borehole junction, the invention is comprised of a method for directing a first object into the primary borehole from the main borehole and directing a second object into the secondary borehole from the main borehole, the method comprising:

(a) positioning in the borehole at the borehole junction a deflector for the purpose of directing the second object into the secondary borehole from the main borehole and for the purpose of facilitating the direction of the first object into the primary borehole, wherein the deflector defines a deflector conduit extending therethrough to facilitate communication between the main borehole and the primary borehole when the deflector is positioned in the borehole at the borehole junction;

(b) inserting into the main borehole the first object, the second object and a retainer for holding the first object and the second object relative to each other such that when the first object is aligned to be directed into the primary borehole the second object is also aligned to be directed into the secondary borehole;

(c) orienting the retainer relative to the borehole junction so that the first object is aligned to be directed into the first borehole and the second object is aligned to be directed into the secondary borehole; and (d) directing the first object into the primary borehole and directing the second object into the secondary borehole by bringing the first object and the second object into contact with the deflector.

In the second aspect, the first object and the second object may be comprised of any tool or other equipment desired or required to be run into the primary and secondary boreholes respectively. However, preferably, the first object is a first tubing string and the second object is a second tubing string.

The deflector positioning step may be performed in any manner and by any mechanism capable of positioning the deflector in the borehole at the borehole junction such that the deflector may direct the second object into the secondary borehole from the main borehole and facilitate the direction of the first object into the primary borehole from the main borehole. However, the deflector positioning step preferably includes the step of orienting the deflector at the borehole junction so that the second object may be directed into the secondary borehole. Further, the deflector is preferably comprised of a lower end, wherein the lower end of the deflector further comprises a deflector extension. In this case, the deflector positioning step further preferably includes the step of engaging the deflector extension with a primary borehole seat associated with the primary borehole.

The directing step may be performed in any manner and by any mechanism capable of directing the first object into the primary borehole and directing the second object into the secondary borehole by bringing the first object and the second object into contact with the deflector. However, the directing step preferably includes the steps of engaging a lower end of the first tubing string with a deflector seat associated with the deflector conduit and engaging a lower end of the second tubing string with a secondary borehole seat associated with the secondary borehole. Further, the first tubing string is preferably directed into the primary borehole before the lower end of the second tubing string becomes engaged with the secondary borehole seat. In the preferred embodiment of the method, the lower end of the first tubing string becomes engaged with the deflector seat at substantially the same time that the lower end of the second tubing string becomes engaged with the secondary borehole seat.

In the method of the within invention, the method may be performed using any suitable device or apparatus capable of being used to perform the particular method steps set out herein. However, preferably, the method is performed using the apparatus of the within invention.

BRIEF DESCRIPTION OF DRAWINGS

Embodiments of the invention will now be described with reference to the accompanying drawings, in which.

DETAILED DESCRIPTION OF INVENTION

Figure 1:
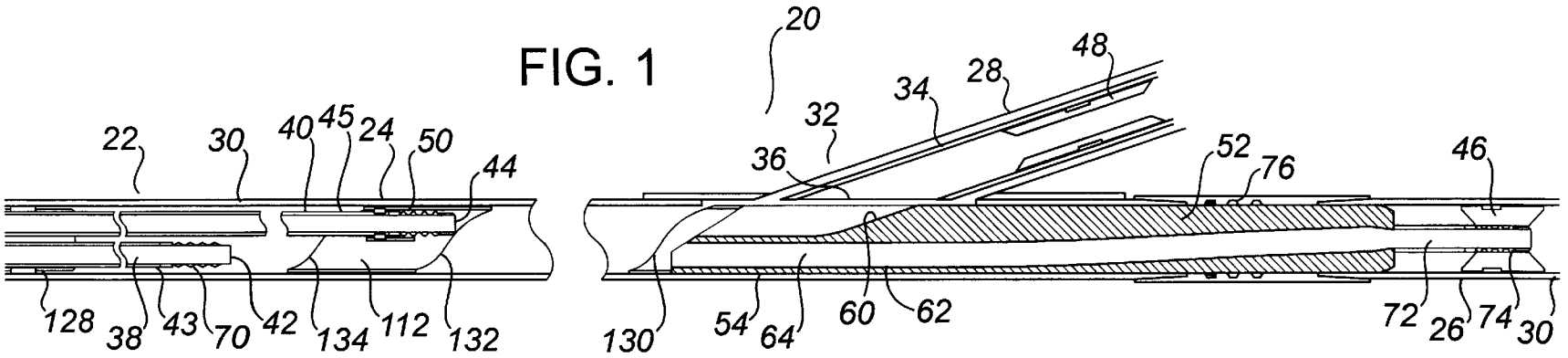
FIG. 1 is a longitudinal sectional view of a preferred embodiment of the apparatus within a borehole, wherein the apparatus is directing a first tubing string and a second tubing string into a primary and a secondary borehole respectively from a main borehole, and showing the use of a dual bore packer.

The present invention is directed at an apparatus (20) and a method to be used for directing two or more objects in a borehole (22). In particular, referring to FIGS. 1–6 and 18–21, the borehole (22) is of the type comprising a main borehole (24), a primary borehole (26) and at least one secondary borehole (28). The main borehole (24) is preferably drilled from the surface to a predetermined or desired depth and location beneath the surface using known drilling technology. The main borehole (24) may be comprised of a substantially vertical borehole, such that the longitudinal axis of the borehole (24) is substantially perpendicular to the ground surface, or it may have any other desired orientation beneath the ground surface. For instance the main borehole (24) may be comprised of a deviated borehole such that its longitudinal axis is not substantially perpendicular to the ground surface. Further, the main borehole (24) may not extend directly to the surface, but may be comprised of a lateral or horizontal borehole which intersects and is in communication with a further vertical or deviated borehole which then extends to the surface for production of the well.

The main borehole (24) may be left open hole or lined in any suitable, known manner to prevent collapse of the main borehole (24). However, preferably, the main borehole (24) is cased such that the main borehole (24) contains a casing string (30), as shown in FIGS. 1–6 and 18–21. The casing string (30) is formed or provided within the main borehole (24) using conventional casing techniques.

The primary borehole (26) and the secondary borehole (28), or boreholes where there is greater than one, intersect with the main borehole (24). In other words, the longitudinal axes of the primary and secondary boreholes (26, 28) intersect or coincide with the longitudinal axis of the main borehole (24). For instance, as shown in FIGS. 1–6 and 18–21, the longitudinal axis of the primary borehole (26) coincides with the longitudinal axis of the main borehole (24) such that the primary borehole (26) forms a continuation of the main borehole (24), while the longitudinal axis of the secondary borehole (28) intersects therewith. The location of the intersection of the primary, secondary and main boreholes (26, 28, 24) defines a borehole junction (32). The borehole junction (32) permits communication between the boreholes (24, 26, 28) such that objects, including drilling and other equipment, may be passed or directed from the main borehole (24) into the primary and secondary boreholes (26, 28) and such that fluids may be produced therethrough.

Although in the preferred embodiment of the within invention the borehole (22) is comprised of only one secondary borehole (28), the invention may also be used where the borehole (22) is comprised of two or more secondary boreholes (28) intersecting with the main borehole (24) at the borehole junction (32). In addition, the invention may also be used where the borehole (22) is comprised of greater than one borehole junction (32). In this case, the apparatus (20) and the method will be applied in succession to each of the borehole junctions (32) commencing with the most distal borehole junction (32) and working back towards the surface.

The primary and secondary boreholes (26, 28) are drilled from the main borehole (24) using known drilling technology such that they each extend from the main borehole (24), at any desired angle or orientation to the main borehole (24), for a predetermined or desired distance. Preferably, each of the primary and secondary boreholes (26, 28) extends to a subterranean formation containing hydrocarbon reserves for production to the surface. Further, preferably, as indicated above, the primary borehole (26) is simply a continuation or extension of the main borehole (24) such that the main and primary boreholes (24, 26) are drilled as a single borehole. The secondary borehole (28) preferably extends laterally from the main borehole (24) to the subterranean formation.

The primary and secondary boreholes (26, 28) may similarly be left open hole or lined in any suitable, known manner to prevent collapse of the primary and secondary boreholes (26, 28). However, preferably, the primary borehole (26) is cased in a manner similar to the main borehole (24), such that it similarly contains the casing string (30) as shown in FIGS. 1–6 and 18–21. Preferably, the secondary borehole (28) includes a liner (34) as shown in FIG. 1–6 and 18–21. The liner (34) may be any conventional liner, including a perforated liner, a slotted liner or a prepacked liner.

The borehole junction (32) may be formed in any conventional manner using known techniques. For instance, the secondary borehole (28) may be drilled and produced through a gap in the casing string (30) of the main and primary boreholes (24, 26). This gap may be comprised of a window (36) cut or milled in a section or area of the casing string (30) using a conventional drilling whipstock or other known equipment or techniques.

The apparatus (20) and method are provided for use in directing a first object into the primary borehole (26) from the main borehole (24) and directing a second object into the secondary borehole (28) from the main borehole (24). Preferably, the first and second objects are directed through the borehole (22) concurrently such that only a single trip downhole is required in order to direct the first and second objects into their respective primary and secondary boreholes (26, 28).

Figure 12:
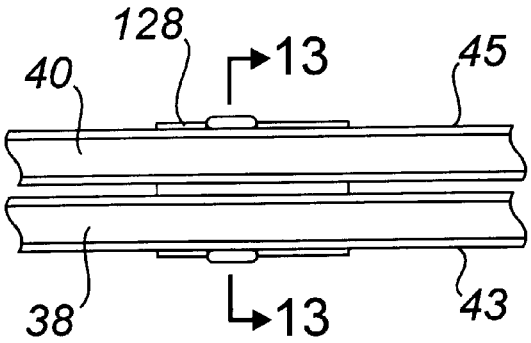
FIG. 12 is a longitudinal sectional view of the dual bore packer shown in FIG. 1.
Figure 13:
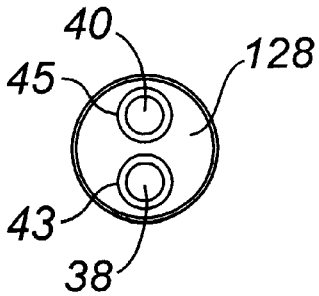
FIG. 13 is a cross-sectional view of the dual bore packer taken along lines 13—13 of FIG. 12.

Each of the first and second objects may be comprised of any downhole drilling or production tool, equipment, apparatus or the like desired or required to be directed into the primary and secondary boreholes (26, 28) respectively. However, in the preferred embodiment, the first object is comprised of a first tubing string (38) and the second object is comprised of a second tubing string (40). Any conventional tubing strings may be used. As shown in detail in FIGS. 11–13, the first tubing string (38) has a lower end (42) conventionally referred to as a stinger, for directing into the primary borehole (26), and an external surface (43). The second tubing string (40) similarly has a lower end (44) or a stinger, for directing into the secondary borehole (28), and an external surface (45).

Referring to FIGS. 1–6 and 18–21, in the preferred embodiment, a primary borehole seat (46) is associated with the primary borehole (26) and a secondary borehole seat (48) is associated with the secondary borehole (28). The primary borehole seat (46) is described below in connection with the apparatus (20). The secondary borehole seat (48) may be comprised of any conventional structure, mechanism or device able to engage the lower end (44) of the second tubing string (40) such that communication between the second tubing string (40) and the secondary borehole (28) is facilitated.

Preferably, the external surface (45) of the lower end (44) of the second tubing string (40) engages the secondary borehole seat (48) in a manner to provide a sealed connection between the second tubing string (40) and the secondary borehole (28) in order to facilitate the movement of fluid therethrough. Any conventional sealing device or structure may be used to provide this sealed connection. The sealing device or structure may be associated or cooperate with or form an integral part of either the secondary borehole seat (48) or the lower end (44) of the second tubing string (40). For instance, the sealing device or structure may be comprised of one or a combination of seals or a friction fit between the adjacent surfaces of the secondary borehole seat (48) and the second tubing string (40). Further, the secondary borehole seat (48) may be comprised of one or a combination of packers, slips, liners or cementing.

However, in the preferred embodiment, the secondary borehole seat (48) is comprised of a packer with a polished bore receptacle (PBR). Preferably, an elongate packer is utilized to permit the second tubing string (40) to be engaged therein, while allowing or providing for some margin of error in the placement or locating of the second tubing string (40) within the secondary borehole (28). Further, to facilitate the sealed connection, as shown in detail in FIGS. 11–14 and 25, the lower end (44) of the second tubing string (40) is preferably comprised of a second stinger seal assembly (50). The second stinger seal assembly (50) is associated with the external surface (45) of the second tubing string (40), preferably at, adjacent or in proximity to the lower end (44). The second stinger seal assembly (50) is comprised of a conventional seal or other sealing structure.

The apparatus (20) is comprised of a deflector (52), a retainer and a retainer orienting mechanism. The deflector (52) is for positioning in the borehole (22) at the borehole junction (32) in order to direct the second tubing string (40) into the secondary borehole (28) from the main borehole (24) and in order to facilitate the direction of the first tubing string (38) into the primary borehole (26) from the main borehole (24). The retainer is for inserting into the main borehole (24) to hold the first and second tubing strings (38, 40) relative to each other such that when the first tubing string (38) is aligned to be directed into the primary borehole (26), the second tubing string (40) is also aligned to be directed into the secondary borehole (28). Finally, the retainer orienting mechanism is for orienting the retainer relative to the borehole junction (32) so that the first tubing string (38) is aligned to be directed into the primary borehole (26) and the second tubing string (40) is aligned to be directed into the secondary borehole (28).

Referring to FIGS. 1–6 and 18–21, the deflector (52) is positioned or located in the borehole (22) adjacent to the borehole junction (32). In particular, the deflector (52) is substantially located within the borehole junction (32) itself and the primary borehole (26) adjacent thereto, such that when objects are inserted through the main borehole (24), the objects can be deflected into the secondary borehole (28) at the borehole junction (32) as a result of contact with the deflector (52). The deflector (52) may be anchored, installed or maintained in position within the borehole (22) using any suitable conventional apparatus, device or technique. Although the deflector (52) may be permanently anchored or installed in the borehole (22), the deflector (52) is preferably removably installed in the borehole (22) such that it may be removed when no longer desired or required. For instance, as discussed further below, a conventional orienting latch assembly may be used for removably anchoring and orienting the deflector (52) in the borehole (22).

Figure 7:
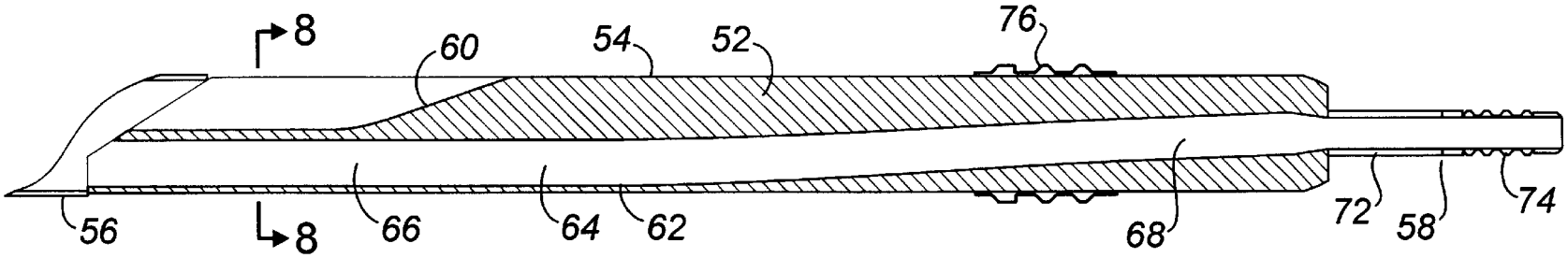
FIG. 7 is a longitudinal sectional view of a deflector of the apparatus shown in FIGS. 1 and 3.
Figure 8:
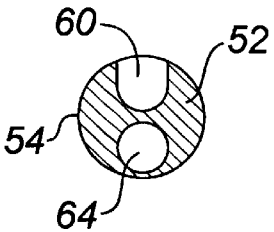
FIG. 8 is a cross-sectional view of the deflector taken along lines 8—8 of FIG. 7.
Figure 22:
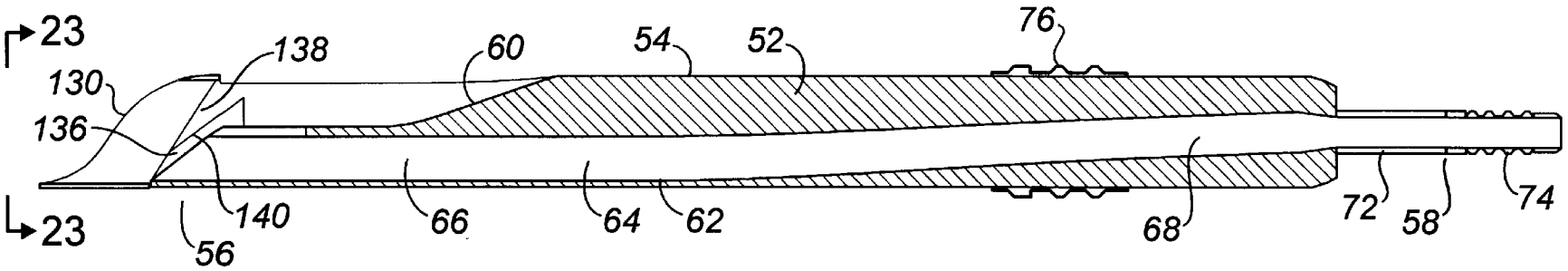
FIG. 22 is a longitudinal sectional view of a deflector of the apparatus shown in FIG. 18.
Figure 23:
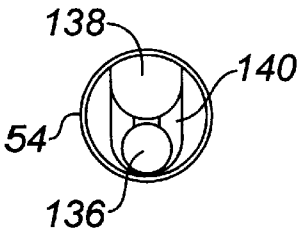
FIG. 23 is a cross-sectional view of the deflector taken along lines 23—23 of FIG. 22.
Figure 25:
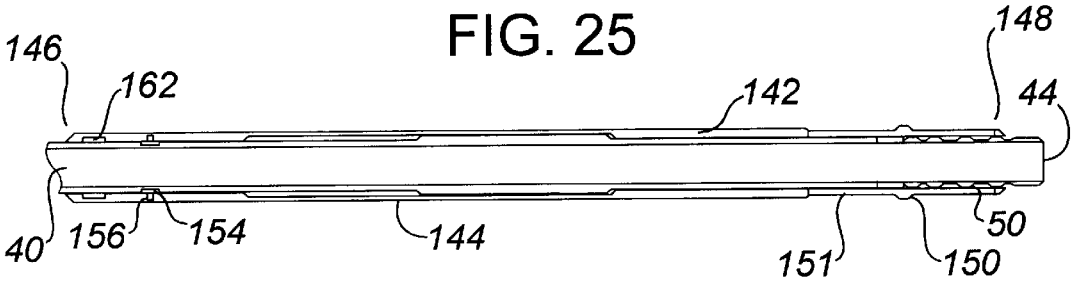
FIG. 25 is a longitudinal sectional view of a lower end of the second tubing string comprising a detachable expansion as shown in FIG. 18.

Referring to FIGS. 7, 8 and 22–24, the deflector (52) may be comprised of any conventional deflector or deflecting assembly, such as a whipstock or a diverter mandrel, capable of deflecting the second object into the secondary borehole (28) and facilitating the direction of the first object into the primary borehole (26). The deflector (52) has an external surface (54), an upper end (56) and a lower end (58). The external surface (54) of the deflector (52) may have any shape or configuration so long as the deflector (52) may be inserted in the main and primary boreholes (24, 26) in the manner described herein. However, the external surface (54) of the deflector (52) is preferably substantially tubular or cylindrical such that the deflector (52) is generally circular on cross-section, as shown in FIGS. 8 and 23. Where the deflector (52) is cylindrical, the deflector (52) defines an external diameter. Where the deflector (52) is not cylindrical, the external diameter of the deflector (52) is defined by the maximum cross-sectional dimension of the deflector (52). In any event, the maximum external diameter of the deflector (52) is less than the internal diameters of the main and primary boreholes (24, 26) so that the deflector (52) may be inserted therein.

The deflector (52) may have any external diameter less than the described maximum external diameter. However, preferably, the external diameter of at least a portion of the deflector (52) is about equal to the internal diameter of the primary borehole (24) while still allowing the deflector (52)

to be inserted therein. Thus, the external diameter of at least a portion of the deflector (52) is slightly or marginally less than the internal diameter of the primary borehole (24). As a result, in the preferred embodiment, the external surface (54) of at least a portion of the deflector (52) will be adjacent or in close proximity to the internal surface of the casing string (30) when the deflector (52) is positioned in the primary borehole (26) adjacent the borehole junction (32).

Figure 18:
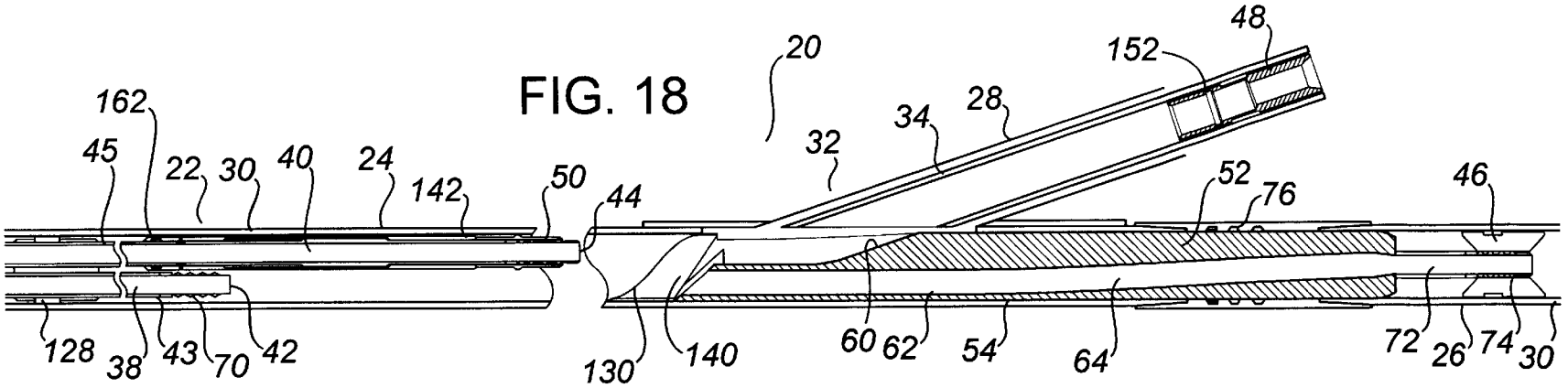
FIG. 18 is a longitudinal sectional view of an alternate embodiment of the apparatus within a borehole, wherein the apparatus is directing the first tubing string and the second tubing string into the primary and the secondary borehole respectively from the main borehole.

The deflector (52) further comprises a deflecting surface (60) located at the upper end (56) of the deflector (52) and a deflector seat (62) for engagement with the first tubing string (38) when the first tubing string (38) is directed into the primary borehole (26). As stated, any conventional deflector (52), such as a whipstock or diverter mandrel, having a deflecting surface (60) and a deflector seat (62), may be used. Preferably, as shown in FIGS. 7–8 and 22–23, the deflecting surface (60) is offset to one side adjacent the external surface (54). When positioned adjacent the borehole junction (32), as shown in FIGS. 1 and 18, the deflecting surface (60) is located adjacent the secondary borehole (28) such that objects inserted through the main borehole (24) may be deflected into the secondary borehole (28). The deflecting surface (60) may have any shape and dimensions suitable for performing this function, however, in the preferred embodiment, the deflecting surface (60) provides a sloped surface which slopes from the upper end (56) of the deflector (52) downwards, towards the lower end (58) of the deflector (52), and outwards, towards the external surface (54) of the deflector (52).

The deflector seat (62) may be comprised of any conventional structure, mechanism or device capable of engaging the first tubing string (38) when it is directed into the primary borehole (26) in the manner described herein. However, the deflector (52) preferably further comprises a deflector conduit (64) extending therethrough to facilitate communication between the main borehole (24) and the primary borehole (26) when the deflector (52) is positioned in the borehole (22) at the borehole junction (32). The deflector seat (62) is preferably associated with the deflector conduit (64). More preferably, the deflector conduit (64) comprises the deflector seat (62) for engaging the first tubing string (38) when it is directed into the primary borehole (26).

The deflector conduit (64) extends through the deflector (52) from its upper end (56) to its lower end (58). In the preferred embodiment, when viewing the deflector (52) from its upper end (56), as shown in FIGS. 8 and 23, the deflector conduit (64) is offset to one side opposite the deflecting surface (60). The deflector conduit (64) preferably includes an upper section (66), adjacent the upper end (56) of the deflector (52), communicating with a lower section (68), adjacent the lower end (58) of the deflector (52). All or a portion of the upper or lower sections (66, 68) of the deflector conduit (64) may comprise the deflector seat (62). However, preferably, all or a portion of the upper section (66) of the deflector conduit (64) comprises the deflector seat (62).

Figure 2:
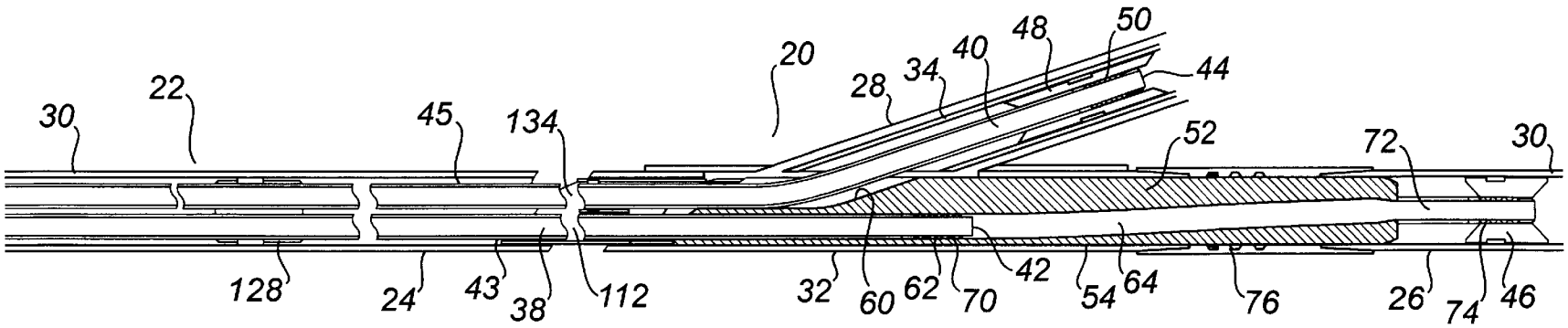
FIG. 2 is a longitudinal sectional view of the apparatus shown in FIG. 1, wherein the first and second tubing strings have been directed into the primary and secondary boreholes respectively.
Figure 4:
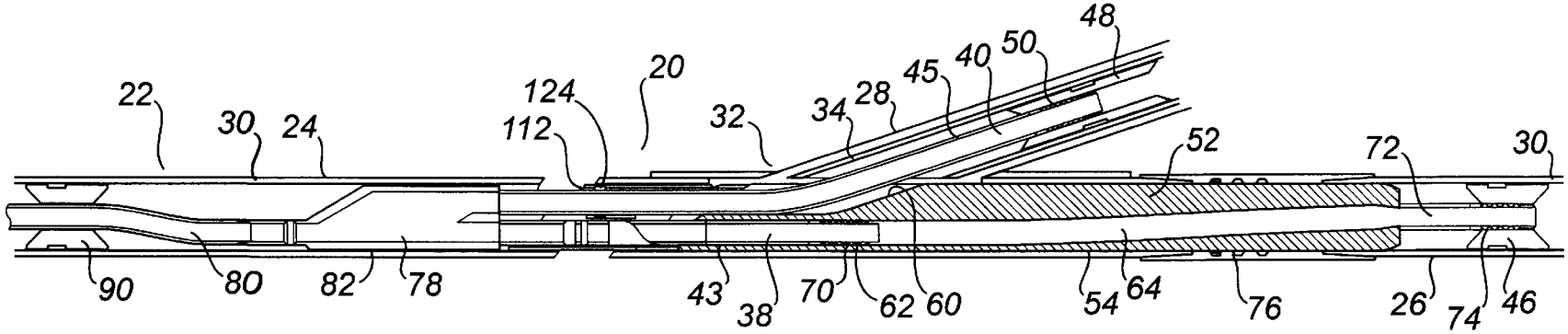
FIG. 4 is a longitudinal sectional view of the apparatus shown in FIG. 3, wherein the first and second tubing strings have been directed into the primary and secondary boreholes respectively.
Figure 21:
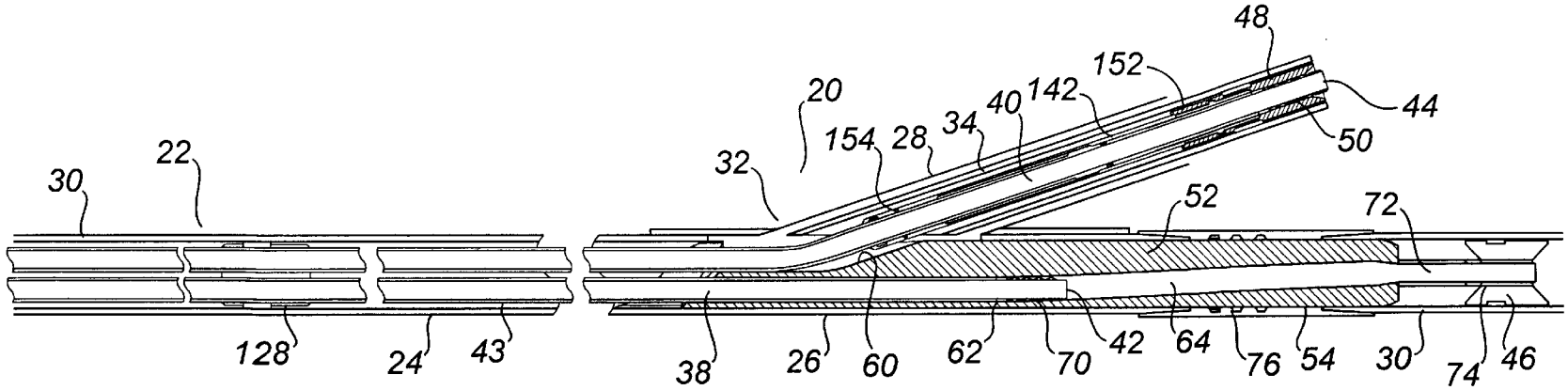

As shown in FIGS. 2, 4 and 21, the deflector seat (62) is comprised of at least the upper section (66) of the deflector conduit (64), which is shaped or configured to closely engage the first tubing string (38) therein. Further, the external surface (43) of the lower end (42) of the first tubing string (38) preferably engages the deflector seat (62) in a manner to provide a seal or a sealed connection between the first tubing string (38) and the deflector conduit (64) in order to facilitate the movement of fluid therethrough. Any conventional sealing device or structure may be used to provide this sealed connection. The sealing device or structure may be associated or cooperate with or form an integral part of either the deflector seat (62) or the lower end (42) of the first tubing string (38). For instance, the sealing device or structure may be comprised of one or a combination of seals or a friction fit between the adjacent surfaces of the deflector seat (62), being the bore of the deflector conduit (64), and the external surface (43) of the first tubing string (38).

However, preferably, as shown in FIGS. 2, 4 and 21, the lower end (42) of the first tubing string (38) is preferably comprised of a first stinger seal assembly (70). The first stinger seal assembly (70) is associated with the external surface (43) of the first tubing string (38), preferably at, adjacent or in proximity to the lower end (42). The first stinger seal assembly (70) is comprised of a conventional seal or other sealing structure.

As well, the lower end (58) of the deflector (52) preferably engages the primary borehole seat (46) associated with the primary borehole (26). The primary borehole seat (46) may be comprised of any conventional structure, mechanism or device able to engage the lower end (42) of the deflector (52) such that communication between the deflector (52) and the primary borehole (26) is facilitated.

Preferably, as shown in FIGS. 7 and 22, the lower end (58) of the deflector (52) preferably comprises a deflector extension (72) for engaging the primary borehole seat (46). In this case, the deflector conduit (64) extends from the upper end (56) of the deflector (52) to the lower end (58) through the deflector extension (72). The deflector extension (72) may have any shape or configuration compatible with the primary borehole seat (46) such that it may be engaged thereby in a manner facilitating communication between the deflector (52) and the primary borehole (26).

Preferably, as particularly shown in FIGS. 7–8 and 22–24, the external surface (54) of the deflector extension (72) engages the primary borehole seat (46) in a manner to provide a sealed connection between the deflector (52) and the primary borehole (26) in order to facilitate the movement of fluid therethrough. Any conventional sealing device or structure may be used to provide this sealed connection. The sealing device or structure may be associated or cooperate with or form an integral part of either the primary borehole seat (46) or the deflector extension (72). For instance, the sealing device or structure may be comprised of one or a combination of seals or a friction fit between the adjacent surfaces of the primary borehole seat (46) and the deflector extension (72). Further, the primary borehole seat (46) may be comprised of one or a combination of packers, slips, liners or cementing.

However, as shown in FIGS. 1–6 and 18–21, the primary borehole seat (46) is preferably comprised of a packer with a polished bore receptacle (PBR). Further, to facilitate the sealed connection, as shown in detail in FIGS. 7 and 22, the deflector extension (72) is preferably comprised of a deflector stinger seal assembly (74). The deflector stinger seal assembly (74) is associated with the external surface (54) of the deflector extension (72),. The deflector stinger seal assembly (74) is comprised of a conventional seal or other sealing structure.

Finally, the apparatus (20) may further comprise a deflector orienting mechanism (76) associated with the deflector (52) for orienting the deflector (52) relative to the borehole junction (32), as described above, so that the second tubing string (40) may be directed into the secondary borehole (28). The deflector orienting mechanism (76) may be comprised of any conventional orienting mechanism, apparatus or device. However, preferably, the deflector orienting mechanism (76) is comprised of a conventional orienting latch assembly.

As indicated previously, the apparatus (20) and the method preferably permit the first and second tubing strings (38, 40) to be produced separately or in a commingled production, as desired. Where separate production of the tubing strings (38, 40) is desired, each of the first and second tubing strings (38, 40) extends from the primary and secondary boreholes (26, 28) respectively through the main borehole (24) to the surface. However, where commingled production is desired, or where the borehole (22) includes greater than one borehole junction (32), the apparatus (20) may further be comprised of a manifold (78) for inserting in the main borehole (24). Referring to FIGS. 3–6 and 14–15, the manifold (78) combines the first tubing string (38) and the second tubing string (40) into a third tubing string (80).

Figure 15:
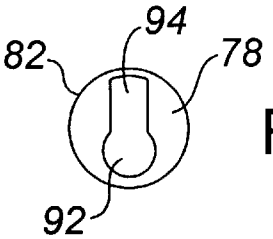
FIG. 15 is a cross-sectional view of the manifold taken along line 15—15 of FIG. 14.

The manifold (78) has an external surface (82), an upper end (84) and a lower end (86). The external surface (82) of the manifold (78) may have any shape or configuration so long as the manifold (78) may be inserted in the main borehole (24). However, the external surface (82) of the manifold (78) is preferably substantially tubular or cylindrical such that the manifold (78) is generally circular on cross-section, as shown in FIG. 15. Where the manifold (78) is cylindrical, the manifold (78) defines an external diameter. Where the manifold (78) is not cylindrical, the external diameter of the manifold (78) is defined by the maximum cross-sectional dimension of the manifold (78). In any event, the maximum external diameter of the manifold (78) is less than the internal diameter of the main borehole (24) so that the manifold (78) may be inserted therein.

The lower end (86) of the manifold (78) is for connecting with each of the first and second tubing strings (38, 40), while the upper end (84) is for connecting with the third tubing string (80). Any connecting or fastening mechanism, structure, apparatus or device may be used to make each of the required connections of the tubing strings (38, 40, 80) to the manifold (78). Preferably, a sealed connection is provided between the lower end (86) of the manifold (78) and each of the first and second tubing strings (38, 40) and between the upper end (84) of the manifold (78) and the third tubing string (80). Further, the manifold (78) defines a manifold junction (88) for facilitating communication of the third tubing string (80) with both the first tubing string (38) and the second tubing string (40).

Any conventional manifold (78) may be used. However, preferably, the manifold (78) is comprised of a Vector Block™ (manufactured by Sperry-Sun Drilling Services of Canada, a division of Dresser Industries, Inc.).

Figure 5:
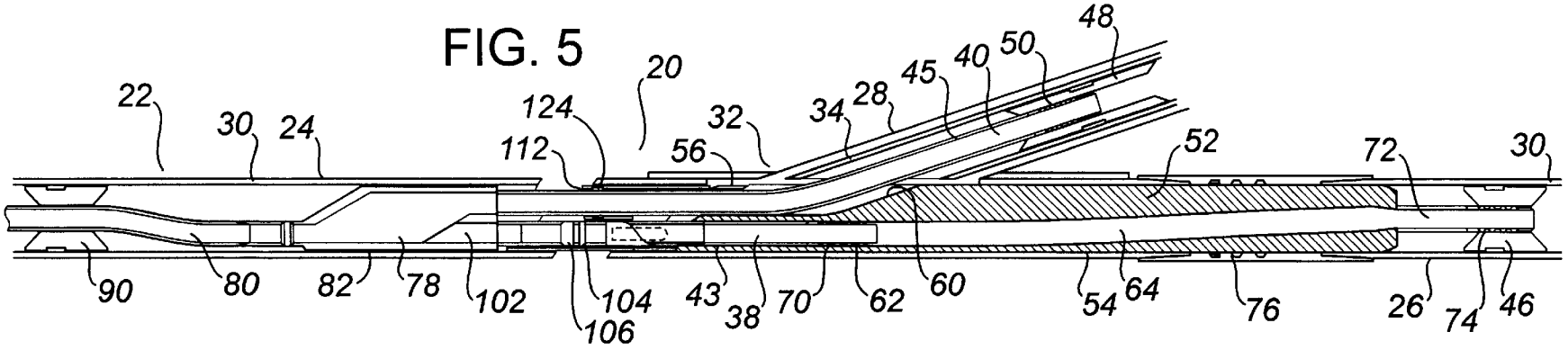
FIG. 5 is a longitudinal sectional view of the apparatus as shown in FIG. 4, wherein a tubing whipstock has been placed therein for re-entry of the borehole.
Figure 6:
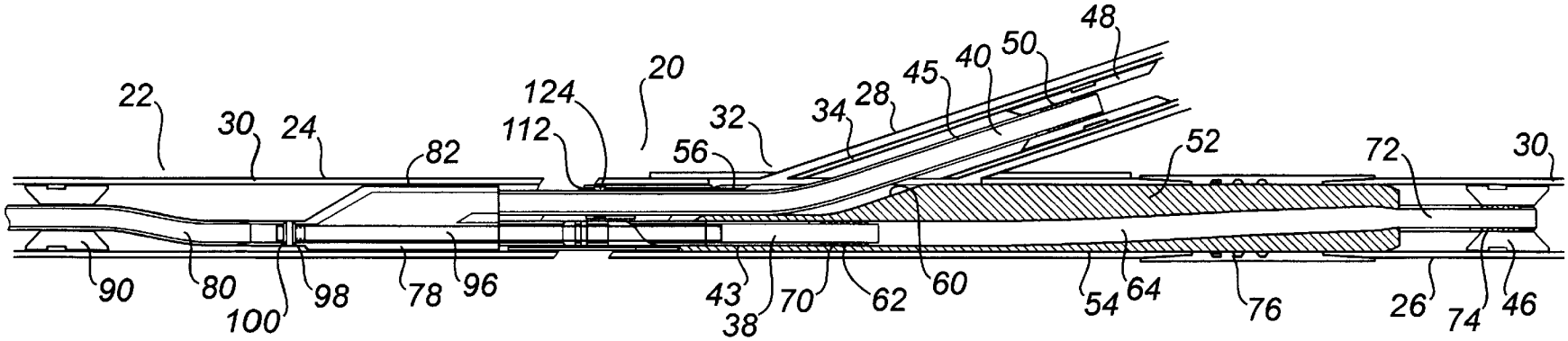
FIG. 6 is a longitudinal sectional view of the apparatus as shown in FIG. 4, wherein an isolation sleeve has been placed therein for isolation of the second tubing string from the first tubing string.

As well, a seal assembly (90) is preferably associated with, or forms or comprises a portion of, the manifold (78) or the third tubing string (80) in order to provide a seal between the manifold (78) or third tubing string (80) and the main borehole (24) once the tubing strings (38, 40) are directed into their respective boreholes (26, 28). As shown in FIGS. 4–6, the seal assembly (90) is preferably located between the external surface of the third tubing string (80) and the internal surface of the casing string (30) of the main borehole (24). The seal assembly (90) is preferably further located at, adjacent or in proximity to the manifold (78). Thus, borehole fluids are inhibited from passing between the third tubing string (80) and the casing string (30) by the seal assembly (90). The seal assembly (90) may be comprised of any conventional seal or sealing structure. For instance, the seal assembly (90) may be comprised of one or a combination of seals, packers, slips, liners or cementing. However, in the preferred embodiment, the seal assembly (90) is comprised of a packer with a sealed connection as shown in FIGS. 4–6.

When utilizing a manifold (78), it is desirable that each of the first and second tubing strings (38, 40) may be re-entered as desired. For this purpose, the manifold junction (88) preferably has the particular internal configuration shown in cross-section in FIG. 15. In particular, on cross-section, at least a portion of the manifold junction (88) defines a primary opening (92) and a smaller secondary opening (94). The size and specific configuration of the secondary opening acts to inhibit the passage of objects through the manifold (78) and into the second tubing string (40). Rather, the passage of the object into the first tubing string (38) is facilitated. However, a smaller secondary opening (94) may not be required in conditions where gravity will assist in passing the object into the first tubing string (38) rather than into the secondary tubing string (40).

Figure 14:
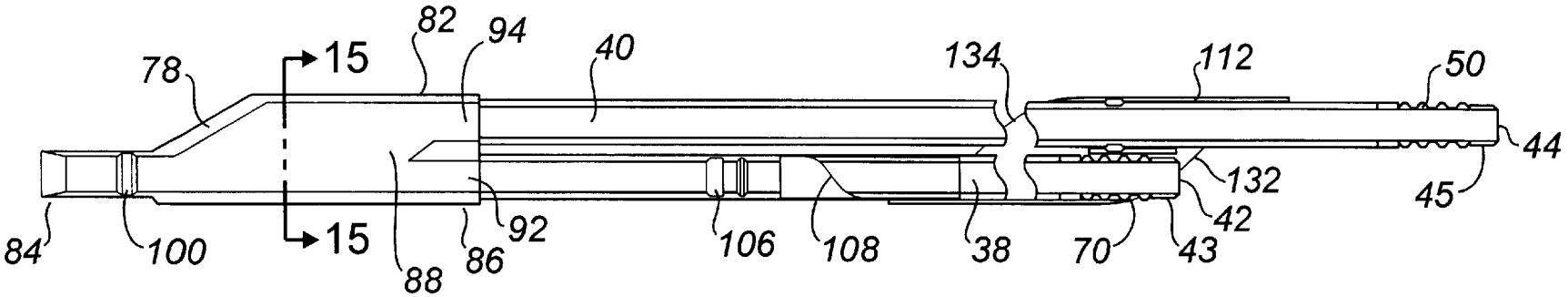
FIG. 14 is a longitudinal sectional view of the tubing carrier, the first and second tubing strings and the manifold shown in FIG. 3.
Figure 16:
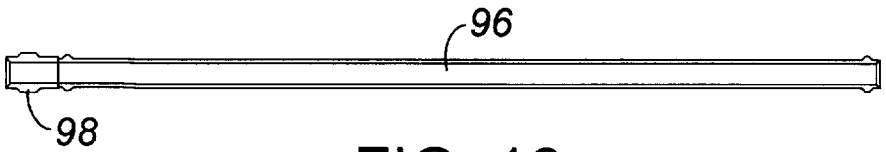
FIG. 16 is a longitudinal section view of the isolation sleeve shown in FIG. 6.

Further, as shown in FIGS. 6 and 16, a conventional isolation sleeve (96) may be inserted in the manifold (78) such that it extends between the upper end (84) of the manifold (78), in communication with the third tubing string (80), and the first tubing string (38). The isolation sleeve (96) may be inserted and anchored into the manifold (78) using any conventional mechanism, structure or device for performing this function. However, preferably, as shown in FIGS. 6, 14 and 16, at least one landing key (98) associated with the isolation sleeve (96) is receivable within a compatible landing profile (100) defined by the upper end (84) of the manifold (78). Further, the outer surface of the isolation sleeve (96) preferably seals with the upper end (84) of the manifold (78) and the inner surface of the first tubing string (38).

Figure 17:
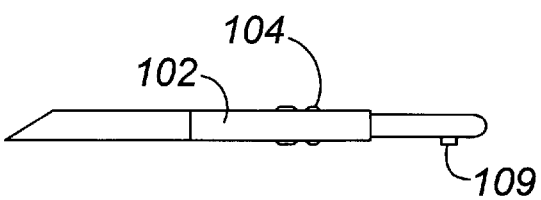
FIG. 17 is a longitudinal sectional view of the tubing whipstock shown in FIG. 5.

For selective re-entry of the second tubing string (40), as shown in FIGS. 5, 14 and 17, a tubing whipstock (102) may be inserted into the lower end (86) of the manifold (78) and the attached first tubing string (38) such that the tubing whipstock (102) is located adjacent the manifold junction (88) for directing objects into the second tubing string (40). The tubing whipstock (102) may be oriented in the manifold (78) and the first tubing string (38) by any mechanism, structure, apparatus or device capable of orienting the tubing whipstock (102) such that objects are directed into the second tubing string (40). For instance, an orienting latch assembly (104), associated with the tubing whipstock (102), may be receivable within a compatible landing profile (106) defined by the first tubing string (38). Alternately, as shown in FIGS. 5, 14 and 17, the first tubing string (38) may be comprised of an orientation muleshoe (108) which is compatible with an orienting key (109) of the tubing whipstock (102).

As stated above, the apparatus (20) is further comprised of the retainer for inserting into the main borehole (24) to hold the first tubing string (38) and the second tubing string (40) relative to each other such that when the first tubing string (38) is aligned to be directed into the primary borehole (26), the second tubing string (40) is also automatically aligned to be directed into the secondary borehole (28). The retainer may be comprised of any conventional device or apparatus capable of holding the first and second tubing strings (38, 40) relative to each other. For instance, the retainer may be comprised of the manifold (78) as described above where commingled production to the surface is desired.

Figure 9:
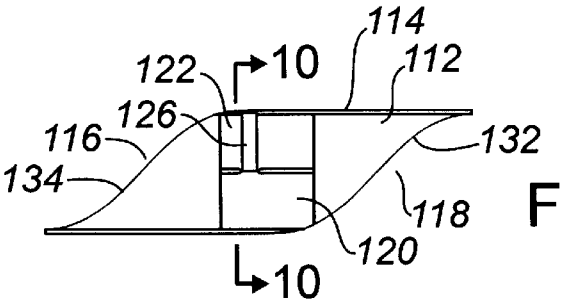
FIG. 9 is a longitudinal sectional view of a tubing carrier of the apparatus shown in FIGS. 1 and 3.
Figure 10:
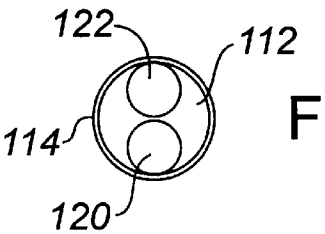
FIG. 10 is a cross-sectional view of the tubing carrier taken along lines 10—10 of FIG. 9.

Alternately, the retainer may be comprised of a tubing carrier (112). Referring to FIGS. 9 and 10, the tubing carrier (112) has an external surface (114), an upper end (116) and a lower end (118). The external surface (114) of the tubing carrier (112) may have any shape or configuration so long as the tubing carrier (112) may be inserted in the main borehole (24). However, the external surface (114) of the tubing carrier (112) is preferably substantially tubular or cylindrical such that the tubing carrier (112) is generally circular on cross-section, as shown in FIG. 10. Where the tubing carrier (112) is cylindrical, the tubing carrier (112) defines an external diameter. Where the tubing carrier (112) is not cylindrical, the external diameter of the tubing carrier (112) is defined by the maximum cross-sectional dimension of the tubing carrier (112). In any event, the maximum external diameter of the tubing carrier (112) is less than the internal diameter of the main borehole (24) so that the tubing carrier (112) may be inserted therein.

Further, referring to FIGS. 9 and 10, the tubing carrier (112) defines a first guide hole (120) for receiving and directing the first tubing string (38) therein and a second guide hole (122) for receiving and directing the second tubing string (40) therein. The tubing carrier (112) may define further guide holes where greater than two tubing strings are being directed downhole. When the first tubing string (38) is received within the first guide hole (120) and the second tubing string (40) is received within the second guide hole (122), the first tubing string (38) and the second tubing string (40) are held relative to each other. When held in position relative to each other by the first and second guide holes (120, 122), each of the first and second tubing strings (38, 40) is preferably permitted to move longitudinally in the direction of its respective longitudinal axis and to rotate about its respective longitudinal axis. However, the position of each longitudinal axis relative to the other within the tubing carrier (112) is not permitted to substantially change.

As stated, each of the first and second tubing strings (38, 40) is preferably permitted to rotate about its longitudinal axis. However, such rotation about its longitudinal axis will not be possible where the apparatus (20) includes a manifold (78) for commingling the production from the first and second tubing strings (38, 40).

Further, as stated, each of the first and second tubing strings (38, 40) is preferably permitted to move longitudinally in the direction of its respective longitudinal axis. In other words, the tubing carrier (112) is preferably capable of permitting longitudinal movement of the first tubing string (38) and the second tubing string (40) relative to the tubing carrier (112). Such longitudinal movement permits the first tubing string (38) and the second tubing string (40) to be directed into the primary and secondary boreholes (26, 28) respectively through the tubing carrier (112). In particular, once the tubing carrier (112) is oriented relative to the borehole junction (32) by the retainer orienting mechanism, the first and second tubing strings (38, 40) may be directed into the primary and secondary boreholes (26, 28).

Figure 11:
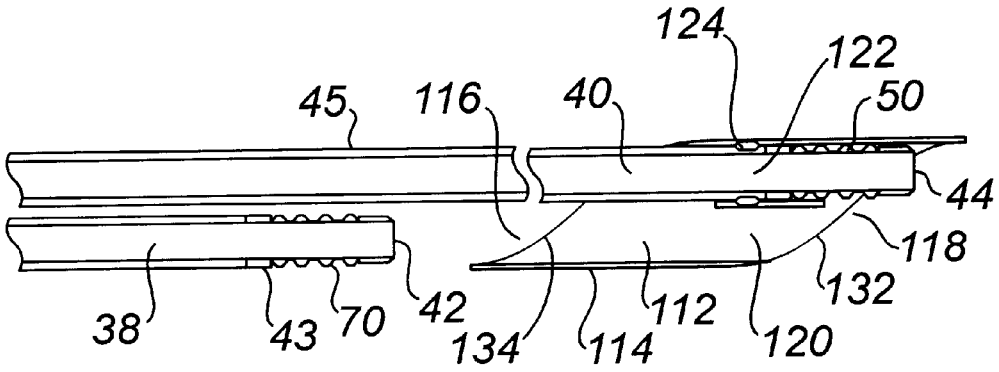
FIG. 11 is a longitudinal sectional view of the tubing carrier of the apparatus and the first and second tubing strings shown in FIGS. 1 and 3.

Referring to FIGS. 9–11, the tubing carrier (112) further comprises a shearable fastener for attaching at least one of the first tubing string (38) and the second tubing string (40) to the tubing carrier (112). The shearable fastener retains the first or second tubing string (38, 40) longitudinally relative to the tubing carrier (112). However, upon shearing of the shearable fastener, the tubing carrier (112) permits the longitudinal movement of the tubing strings (38, 40) relative to the tubing carrier (112). The shearable fastener may attach to either or both of the first tubing string (38) and the second tubing string (40).

Any conventional shearable fastener may be used, such as a shear ring or a shear pin. When using a shear ring, each of the tubing strings (38, 40) is permitted to rotate about its longitudinal axis relative to the tubing carrier (112). This rotational movement may be desirable where the first and second tubing strings (38, 40) are produced separately to the surface. When using a shear pin, rotation of the tubing strings (38, 40) relative to the tubing carrier (112) is inhibited. A shear pin is more typically utilized in combination with a manifold (78) where commingled production to the surface is provided. Referring to FIGS. 9–11, the shearable fastener is comprised of a shear ring (124) associated with the external surface (45) of the second tubing string (40) adjacent its lower end (44) and a compatible shear ring groove (126) defined by the second guide hole (122).

Figure 3:
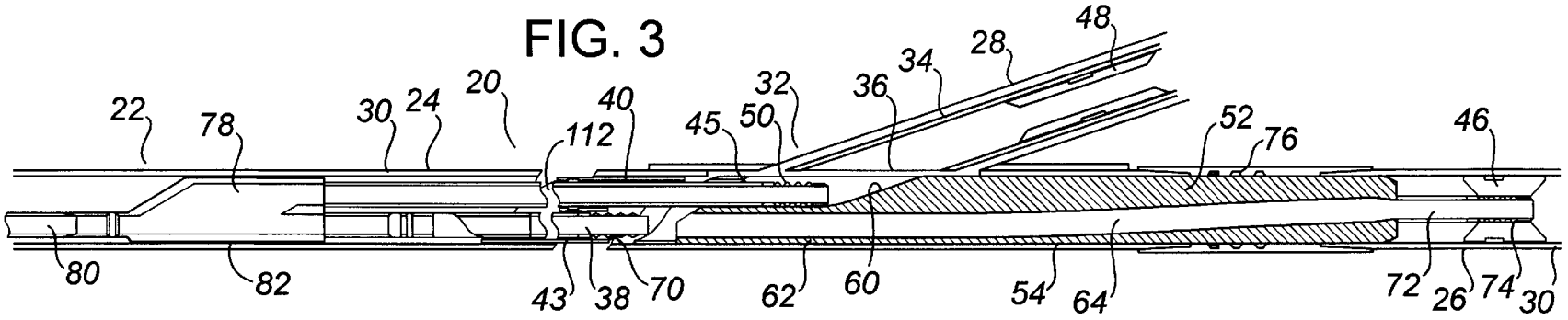
FIG. 3 is a longitudinal sectional view of the preferred embodiment of the apparatus shown in FIG. 1, wherein the apparatus is directing the first tubing string and the second tubing string into the primary and the secondary borehole respectively, and showing the use of a manifold.

However, although the retainer may be comprised of the manifold (78) or the tubing carrier (112), when the first and the second tubing strings (38, 40) are both held by the tubing carrier (112) as shown in FIGS. 3 and 14, the retainer is preferably comprised of a dual bore packer (128) as shown in FIGS. 1–2 and 18–21.

As shown in FIGS. 1–2, 12–13 and 18–21, the dual bore packer (128) is associated with the first and second tubing strings (38, 40) such that the tubing strings (38, 40) are held relative to each other by the dual bore packer (128), in the manner described above for the tubing carrier (112). Further, the dual bore packer (128) may be used for providing a seal between the tubing strings (38, 40) and the main borehole (24). In particular, once the first and second tubing strings (28, 40) are directed into the primary and secondary boreholes (26, 28) respectively, the dual bore packer (128) provides a seal between the external surfaces (53, 45) of the tubing strings (38, 40) and the internal surface of the casing string (30) within the main borehole (24). Further, while the apparatus (20) is being inserted through the main borehole (24), the dual bore packer (128) is preferably located at, adjacent or in proximity to the lower ends (42, 44) of the tubing strings (38, 40) in order to facilitate its performance or functioning as the retainer.

Finally, the apparatus (20) is comprised of the retainer orienting mechanism. The retainer orienting mechanism orients the retainer relative to the borehole junction (32) so that the first tubing string (38) is aligned to be directed into the primary borehole (26) and the second tubing string (40) is aligned to be directed into the secondary borehole (28). Any mechanism, device, apparatus or structure capable of performing this function may be used. For instance, the retainer orienting mechanism may be comprised of a conventional orienting latch assembly. However, preferably, the retainer orienting mechanism is comprised of the upper end (56) of the deflector (52).

In the preferred embodiment of the apparatus (20) as shown in FIGS. 1 through 17, the retainer orienting mechanism is further comprised of the tubing carrier (112) for inserting into the main borehole (24) to hold at least one of the first tubing string (38) and the second tubing string (40) such that orientation of the tubing carrier (112) relative to the deflector (52) causes orientation of the retainer relative to the deflector (52). For clarification, the tubing carrier (112) as described herein may operate as the retainer orienting mechanism as long as at least one of the first or second tubing strings (38, 40) is held thereby, as shown in FIGS. 1–4, 11 and 14. The tubing carrier (112) may also operate as the retainer when both the first and the second tubing strings (38, 40) are held thereby, as shown in FIGS. 3, 4 and 14 The manifold (78) of FIGS. 3, 4 and 14 is provided to commingle the production and not specifically to perform a retaining function. If only one tubing string (38, 40) is held by the tubing carrier (112), a separate retainer is required, such as a manifold(78) or the dual bore packer (128) shown in FIGS. 1, 2 and 11.

As indicated, the retainer orienting mechanism is comprised of the upper end (56) of the deflector (52). More particularly, the upper end (56) of the deflector (52) is comprised of a first surface (130). The first surface (130) is complementary to a second surface (132) on the tubing carrier (112) so that the retainer may be oriented relative to the deflector (52) by engagement of the first surface (130) with the second surface (132). Preferably, the lower end (118) of the tubing carrier (112) is comprised of the second surface (132). The first surface (130) and the second surface (132) may have any complementary configurations permitting the retainer to be oriented relative to the deflector (52) as a result of their engagement. However, in the preferred embodiment, the first surface (130) is comprised of a first orienting muleshoe and the second surface (132) is comprised of a second orienting muleshoe. Upon engagement of the first orienting muleshoe (130) with the second orienting muleshoe (132), the shearable fastener is sheared and longitudinal movement of the first and second tubing strings (38, 40) relative to the tubing carrier (112) is permitted.

The upper end (116) of the tubing carrier (112) may be comprised of a third surface (134) for engagement with further downhole tools or equipment. For instance, the third surface (134) may be engageable with retrieval tools for the removal of the tubing carrier (112) from the borehole (22). The third surface (134) may have any configuration complementary to the tool or equipment to be engaged thereby. However, preferably, the third surface (134) is comprised of a third orienting muleshoe.

Figure 24:
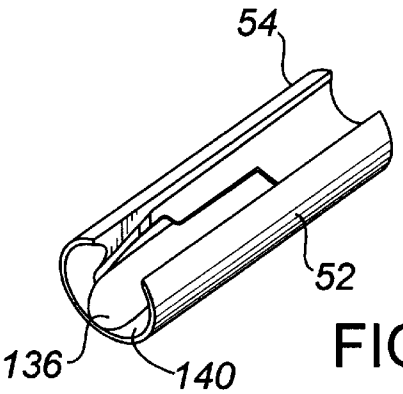
FIG. 24 is a pictorial view of a portion of the deflector shown in FIG. 22, wherein an upper end of the deflector comprising a muleshoe is not shown.

In an alternate embodiment of the apparatus (20) as shown in FIGS. 18 through 27, the retainer orienting mechanism is also comprised of the upper end (56) of the deflector (52). However, in the alternate embodiment, the apparatus (20) is not comprised of the tubing carrier (112). Rather, the retainer is comprised of a manifold (78) or a dual bore packer as shown in FIGS. 18–21. The retainer orienting mechanism is comprised of the upper end (56) of the deflector (52). More particularly, as shown in FIGS. 22–24, the upper end (56) of the deflector (52) defines a primary borehole orifice (136) which communicates with the deflector conduit (64). Further, the upper end (56) of the deflector (52) defines a secondary borehole orifice (138) which communicates with the secondary borehole (28). The retainer orienting mechanism is comprised of the primary borehole orifice (136) and the secondary borehole orifice (138). However, the upper end (56) of the deflector (52) may still include the first surface (130), being a first orienting muleshoe, to facilitate connection of the deflector (52) to other equipment such as retrieval tools.

The size of the primary borehole orifice (136) is different than the size of the secondary borehole orifice (138) so that a selected one of the first or second tubing strings (38, 40) may fit within only the primary or secondary borehole orifice (136, 138) respectively. More particularly, one of the orifices (136, 138) is larger in size than the other and one of the first tubing string (38) and the second tubing string (40) is sized to fit within its respective orifice (136, 138) only. In the preferred alternate embodiment, the secondary borehole orifice (138) is larger in size than the primary borehole orifice (136) and the lower end (44) of the second tubing string (40) is sized to fit within the secondary borehole orifice (138) but not to fit within the primary borehole orifice (136).

Further, where necessary, the upper end (56) of the deflector (52) may be further comprised of an orienting surface (140) for facilitating the direction of the second tubing string (40) into the secondary borehole orifice (138). The preferred configuration or shape of the orienting surface (140) is shown in FIGS. 23 and 24. Specifically, the orienting surface (140) is comprised of a cone-shaped, sloped or curved surface which slopes inwardly and downwardly from the upper end (56) of the deflector (52) adjacent the external surface (54) towards the secondary borehole orifice (138). However, any shape or configuration may be used as long as the orienting surface (140) directs the lower end (44) of the second tubing string (40) toward the secondary borehole orifice (138) when the lower end (44) of the second tubing string (40) is lowered into engagement with the upper end (56) of the deflector (52).

As indicated, the secondary borehole orifice (138) is larger in size than the primary borehole orifice (136) and the lower end (44) of the second tubing string (40) is sized to fit within the secondary borehole orifice (138) but not to fit within the primary borehole orifice (136). Thus, the second tubing string (40) may be selected so that the diameter of the second tubing string (40) permits the lower end (44) to only fit within the secondary borehole orifice (138). However, where the diameter of the second tubing string (40) would permit its entry into the primary borehole orifice (136), the lower end (44) of the second tubing string (40) may be comprised of a detachable expansion (142). In this instance, the lower end (44) of the second tubing string (40) and the detachable expansion (142) are sized such that the lower end (44) of the second tubing string (40) will fit within the secondary borehole orifice (138) with the detachable expansion (142) attached thereto but will not fit within the primary borehole orifice (136).

Further, the expansion (142) is preferably detachable so that the expansion (142) will become detached from the lower end (44) of the second tubing string (40) as the second tubing string (40) is directed into the secondary borehole (28). For this purpose, a constriction is preferably associated with the secondary borehole (28). The lower end (44) of the second tubing string (40) and the detachable expansion (142) are further sized such that the lower end (44) of the second tubing string (40) will fit within the constriction only with the expansion (142) detached from it. Any portion of the secondary borehole (28) or apparatus contained therein may comprise the constriction. However, preferably, the constriction is comprised of the secondary borehole seat (48). Thus, the second tubing string (40) and the detachable expansion (142) fit within the secondary borehole orifice (138). However, upon contact or connection with the secondary borehole seat (48), as described further below, the expansion (142) becomes detached and only the second tubing string (40) is permitted to continue into the secondary borehole (28).

The detachable expansion (142) may have any structure or configuration compatible with its intended function as described herein. However, referring to FIGS. 25–28, the detachable expansion (142) is preferably comprised of a tubular sheath or sleeve detachably mountable about the lower end (44) of the second tubing string (40). The detachable expansion (142) has an external surface (144), an upper end (146) and a lower end (148). At least one landing key (150) is associated with the external surface (144) at, adjacent or in proximity to the lower end (148) of the detachable expansion (142). More particularly, the lower end (148) of the detachable expansion (142) may be comprised of a sheath collet (151) which includes the landing key (150) on the external surface (144) thereof. The landing key (150) of the sheath collet (151) is receivable within a complementary or compatible landing profile (152) defined by the secondary borehole seat (48) such that the detachable expansion (142)

is retained within the secondary borehole seat (48). The landing profile (152) defined by the secondary borehole seat (48), which comprises the constriction, is shown in detail in FIGS. 18–21.

Further, referring to FIGS. 25–28, the detachable expansion (142) further comprises a shearable fastener for attaching the detachable expansion (142) with the lower end (44) of the second tubing string (40). Upon shearing of the shearable fastener, the detachable expansion (142) permits the longitudinal movement of the second tubing string (40) relative to the detachable expansion (142) so that the second tubing string (40) may be directed into the secondary borehole (28). Any conventional shearable fastener may be used, such as a shear ring or a shear pin. Further, the shearable fastener may attach to either or both of the detachable expansion (142) and the second tubing string (40).

However, preferably, the shearable fastener is comprised of a compressible split ring, (154) having an associated shear pin (156), which is compressed and held in place within a compatible split ring groove (158) defined by the lower end (44) of the second tubing string (40). Further, the internal surface of the detachable expansion (142) defines a shear pin hole (160), at, adjacent or in proximity to the upper end (146) of the detachable expansion (142), for receiving the shear pin (156) therein. The internal surface of the detachable expansion (142) also defines a retaining profile (162) for receiving the split ring (154) therein, as described below. Preferably, the retaining profile (162) is positioned between the lower end (148) of the detachable expansion (142) and the shear pin hole (160) as shown in FIG. 26.

Figure 19:
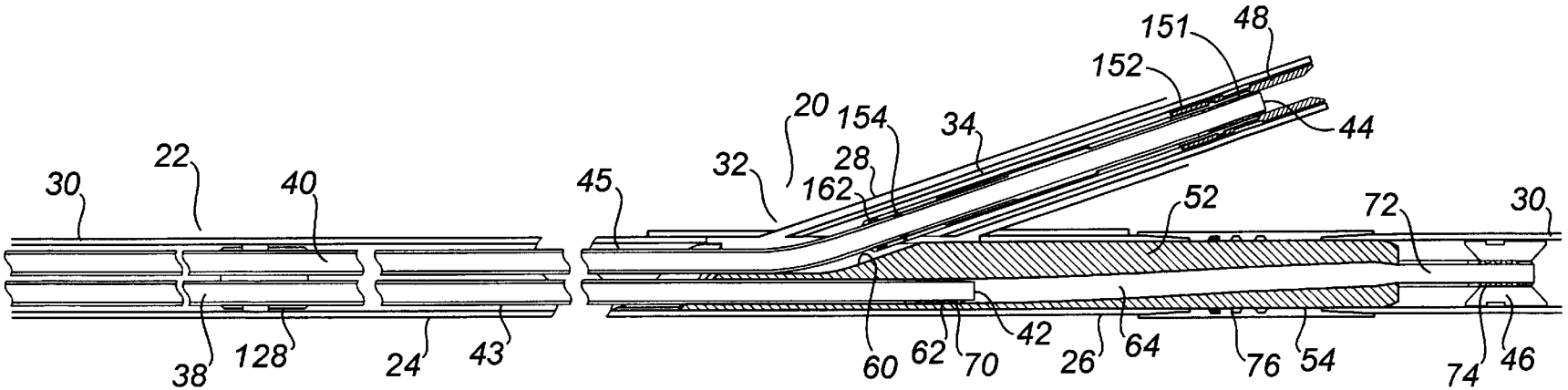
FIGS. 19 through 21 are longitudinal sectional views of the alternate embodiment of the apparatus shown in FIG. 18 in sequence, wherein the first and second tubing strings are being directed into the primary and secondary boreholes respectively.
Figure 20:
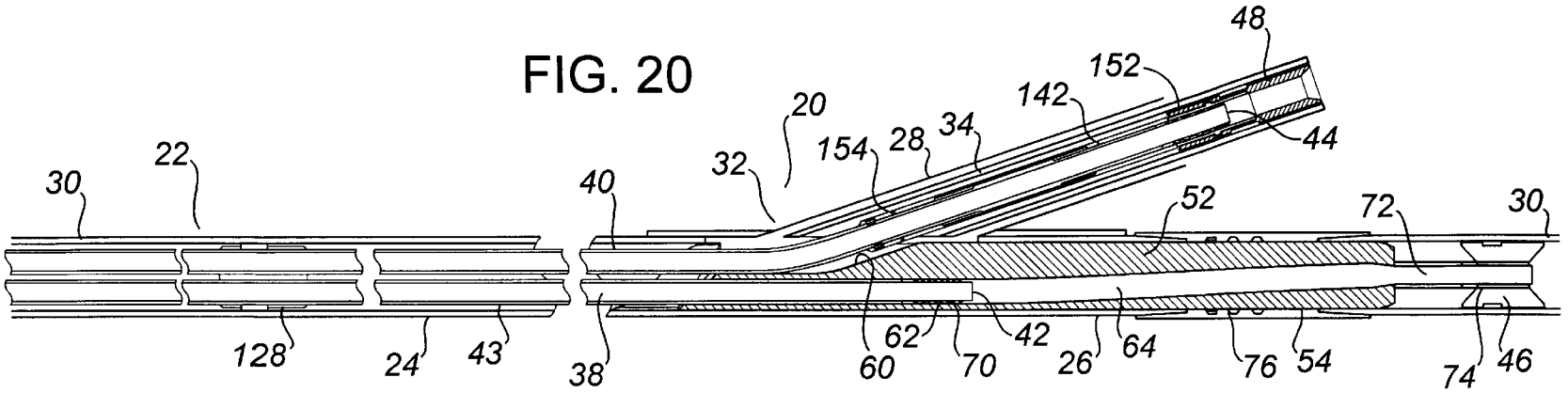

Referring to FIG. 19, upon receiving the landing key (150) of the sheath collet (151) within the landing profile (152) defined by the secondary borehole seat (48), the detachable expansion (142) is retained within the secondary borehole seat (48). Referring to FIG. 20, the second tubing string (40) is then pulled up or a force is applied in the direction of its longitudinal axis away from the secondary borehole seat (48). As a result, the shear pin (156) is sheared and the second tubing string (40) is permitted to move relative to the expansion (142), which is now detached. The second tubing string (40) is moved longitudinally away from the secondary borehole seat (48) until such time that the split ring (154) is received within the retaining profile (162). The second tubing string (40) is then directed longitudinally towards the secondary borehole (28) for engagement with the secondary borehole seat (48) such that the second stinger seal assembly (50) may be sealed therewith, as shown in FIG. 21. Once in place, the dual bore packer (128) may be set in the main borehole (24).

Figure 26:
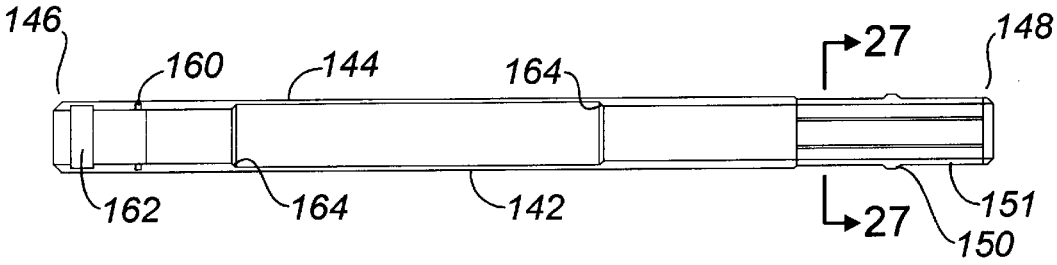
FIG. 26 is a longitudinal sectional view of the detachable expansion shown in FIG. 25.
Figure 27:
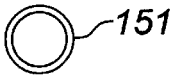
FIG. 27 is a cross-sectional view of the detachable expansion taken along line 27—27 of FIG. 26.
Figure 28:
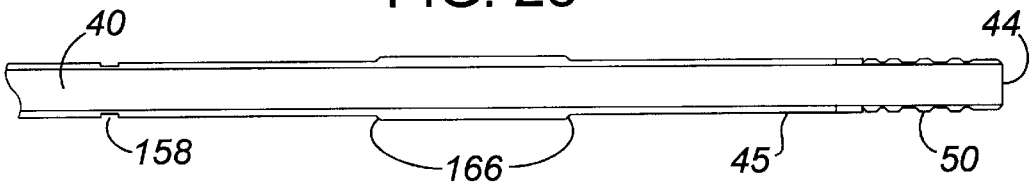
FIG. 28 is a longitudinal sectional view of the second tubing string shown in FIG. 25.

Finally, referring to FIGS. 26 and 28, in order to facilitate the retrieval of the detachable expansion (142) following its detachment from the second tubing string (40), the inner surface of the detachable expansion (142) is preferably comprised of a first retrieval shoulder (164) which is compatible with a second retrieval shoulder (166) comprising the second tubing string (40). In particular, the second retrieval shoulder (166) engages the first retrieval shoulder (164) upon withdrawal of the second tubing string (40) from the secondary borehole (28). As a result, the detachable expansion (142) is removable from the borehole (22) along with the second tubing string (40).

Depending upon the particular retainer and retainer orienting mechanism in use, the tubing strings (38, 40) may be of any lengths permitting the first and second tubing strings (38, 40) to engage the deflector seat (62) and the secondary borehole seat (48) respectively. Further, the tubing strings (38, 40) may have any lengths relative to each other. However, in both the preferred and alternate embodiments of the apparatus (20), the second tubing string (40) is longer than the first tubing string (38) such that the lower end (44) of the second tubing string (40) extends beyond the lower end (42) of the first tubing string (38) as the tubing strings (38, 40) are being inserted through the main borehole (24).

Further, the lengths of the tubing strings (38, 40) are preferably selected so that the first tubing string (38) is directed into the primary borehole (24) before the lower end (44) of the second tubing string (40) becomes engaged with the secondary borehole seat (48). In the preferred and alternate embodiments, the lengths are further selected so that the lower end (42) of the first tubing string (38) becomes engaged with the deflector seat (62) at substantially the same time that the lower end (44) of the second tubing string (40) becomes engaged with the secondary borehole seat (48).

In the preferred and alternate embodiments of the apparatus (20), the borehole junction (32) and the communicating boreholes (24, 26, 28) are preferably hydraulically sealed upon the placement or positioning of the first and second tubing strings (38, 40) in the primary and secondary boreholes (26, 28) as described herein. The hydraulic sealing may be accomplished by any conventional seal assembly or any combination of conventional seal assemblies associated with the apparatus (20) and the tubing strings (38, 40) at any effective locations such that the sealing is achievable. However, preferably, the hydraulic sealing is accomplished by the combination of: the dual bore packer (128) or the packer comprising the seal assembly (90) when using a manifold (78); the engagement of the second stinger seal assembly (50) with the secondary borehole seat (48); the engagement of the first stinger seal assembly (70) with the deflector seat (62); and the engagement of the deflector stinger seal assembly (74) with the primary borehole seat (46).

The within invention is also comprised of a method for directing the first object into the primary borehole (26) from the main borehole (24) and directing the second object into the secondary borehole (28) from the main borehole (24). The main, primary and secondary boreholes (24, 26, 28) are as described above. Further, the main, primary and secondary boreholes (24, 26, 28) may be drilled and completed using any conventional equipment, techniques or methods. Further, the primary borehole seat (46) and the secondary borehole seat (48) may be installed within the primary and secondary boreholes (26, 28) respectively using any conventional equipment, techniques or methods.

As well, the method may be performed using any suitable device or apparatus capable of being used to perform the method steps. However, preferably, the method is performed using the preferred or alternate embodiments of the apparatus (20) of the within invention, as described above.

The method comprises the following steps, which are preferably performed in the sequence set forth. First, the deflector (52) is positioned in the borehole (22) at the borehole junction (32) for the purpose of directing the second object, preferably the second tubing string (40), into the secondary borehole (28) from the main borehole (24) and for the purpose of facilitating the direction of the first object, preferably the first tubing string (38), into the primary borehole (26) from the main borehole (24).

Where necessary, the deflector positioning step may be comprised of the step of orienting the deflector (52) at the borehole junction (32) so that the second tubing string (40)

may be directed into the secondary borehole (28). As well, the positioning step preferably further comprises the step of engaging the deflector extension of the deflector with the primary borehole seat (46) associated with the primary borehole (26).

Second, referring to FIGS. 1, 3 and 18, the first tubing string (38), the second tubing string (40) and the retainer are inserted into the main borehole (24). The retainer holds the tubing strings (38, 40) relative to each other such that when the first tubing string (38) is aligned to be directed into the primary borehole (26), the second tubing string (40) is also aligned to be directed into the secondary borehole (28).

Third, the retainer is oriented relative to the borehole junction (32) so that the first tubing string (38) is aligned to be directed into the primary borehole (26) and the second tubing string (40) is aligned to be directed into the secondary borehole (28).

Finally, referring to FIGS. 2, 4 and 19, the first tubing string (38) is directed into the primary borehole (26) and the second tubing string (40) is directed into the secondary borehole (28) by bringing the first tubing string (38) and the second tubing string (40) into contact with the deflector (52). Preferably, the directing step includes the steps of engaging the lower end (42) of the first tubing string (38) with the deflector seat (62) associated with the deflector conduit (64) and engaging the lower end (44) of the second tubing string (40) with the secondary borehole seat (48) associated with the secondary borehole (28). Further, the first tubing string (38) is preferably directed into the primary borehole (26) before the lower end (44) of the second tubing string (40) becomes engaged with the secondary borehole seat (48). In the preferred embodiment of the method, the lower end (42) of the first tubing string (38) becomes engaged with the deflector seat (62) at substantially the same time that the lower end (44) of the second tubing string (40) becomes engaged with the secondary borehole seat (48).

Once the tubing strings (38, 40) are engaged with the deflector seat (62) and the secondary borehole seat (48), the dual bore packer (128), or the packer comprising the seal assembly (90) when using a manifold (78), is preferably set in the main borehole (24).

Thus, the method of the within invention may be completed in two trips downhole for the placement of the first and second tubing strings (38, 40) in the primary and secondary boreholes (26, 28). A first trip performs the positioning step of the method and thereby positions the deflector (52) at the borehole junction (32). A second trip performs the inserting, orienting and directing steps of the method.

Where the borehole (22) is comprised of greater than one borehole junction (32), the first and second tubing strings (38, 40) may be directed into the primary and secondary boreholes (26, 28) respectively in sequence. In particular, each borehole junction (32) is completed in sequence or in succession commencing with the borehole junction (32) farthest from the surface and working towards the borehole junction (32) nearest to the surface. In this case, the apparatus (20) used for each borehole junction (32), except the borehole junction (32) nearest to the surface, will preferably include a manifold (78) such that the third tubing string (80) extending towards the surface from a lower borehole junction (32) may be connected with the lower end (58) of the deflector (52), and in particular the deflector extension (72), at a borehole junction (32) nearer the surface. Thus, the lower end (58) of the deflector (52) or stinger is stung into and sealed with the third tubing string (80). Alternately, the lower end (58) of the deflector (52) may be stung directly into and sealed with the upper end (84) of the manifold (78).

Finally, the method may further comprise the step of removing all, or any of the elements, of the apparatus (20) from the boreholes (24, 26, 28) as required or desired for any particular use or application of the borehole (22). Any conventional apparatus or techniques may be used to remove the desired elements of the apparatus (20). However, in order to facilitate recovery of the apparatus (20), cementing of the apparatus (20) to obtain the desired sealed connections between the apparatus (20) and the boreholes (24, 26, 28) as described above is not preferred.

The embodiments of the invention in which an exclusive property or privilege is claimed are defined as follows:

1. In a borehole comprising a main borehole, a primary borehole, a secondary borehole and a borehole junction, wherein the main borehole communicates with both the primary borehole and the secondary borehole at the borehole junction, an apparatus for use in directing a first object into the primary borehole from the main borehole and directing a second object into the secondary borehole from the main borehole, the apparatus comprising:

(a) a deflector for positioning in the borehole at the borehole junction in order to direct the second object into the secondary borehole from the main borehole and in order to facilitate the direction of the first object into the primary borehole;

(b) a retainer for inserting into the main borehole to hold the first object and the second object relative to each other such that when the first object is aligned to be directed into the primary borehole the second object is also aligned to be directed into the secondary borehole; and (c) a retainer orienting mechanism for orienting the retainer relative to the borehole junction so that the first object is aligned to be directed into the primary borehole and the second object is aligned to be directed into the secondary borehole.

2. The apparatus as claimed in claim 1 wherein the deflector defines a deflector conduit extending therethrough to facilitate communication between the main borehole and the primary borehole when the deflector is positioned in the borehole at the borehole junction.

3. The apparatus as claimed in claim 2 wherein the deflector comprises an upper end and wherein the retainer orienting mechanism is comprised of the upper end of the deflector.

4. The apparatus as claimed in claim 3 wherein the first object is a first tubing string and wherein the second object is a second tubing string.

5. The apparatus as claimed in claim 4 wherein the deflector conduit comprises a deflector seat for engaging the first tubing string when it is directed into the primary borehole.

6. The apparatus as claimed in claim 5 further comprising a deflector orienting mechanism associated with the deflector for orienting the deflector relative to the borehole junction so that the second tubing string may be directed into the secondary borehole.

7. The apparatus as claimed in claim 6 wherein the deflector further comprises a lower end, wherein the lower end of the deflector comprises a deflector extension for engaging a primary borehole seat associated with the primary borehole and wherein the deflector conduit extends from the upper end of the deflector to the lower end of the deflector through the deflector extension.

8. The apparatus as claimed in claim 5 wherein the retainer orienting mechanism is further comprised of a tubing carrier for inserting into the main borehole to hold at least one of the first tubing string and the second tubing string such that orientation of the tubing carrier relative to the deflector causes orientation of the retainer relative to the deflector.

9. The apparatus as claimed in claim 8 further comprising a first surface on the upper end of the deflector and a second surface on the tubing carrier which is complementary to the first surface on the deflector so that the retainer may be oriented relative to the deflector by engagement of the first surface with the second surface.

10. The apparatus as claimed in claim 9 wherein the first surface is a first orienting muleshoe and wherein the second surface is a second orienting muleshoe.

11. The apparatus as claimed in claim 10 wherein the tubing carrier is capable of permitting longitudinal movement of the first tubing string and the second tubing string relative to the tubing carrier so that the first tubing string and the second tubing string may be directed into the primary borehole and the secondary borehole respectively when the first surface on the deflector is engaged with the second surface on the tubing carrier.

12. The apparatus as claimed in claim 11 wherein the tubing carrier further comprises a shearable fastener for attaching at least one of the first tubing string and the second tubing string to the tubing carrier so that the tubing carrier is capable of permitting longitudinal movement of the first tubing string and the second tubing string relative to the tubing carrier upon shearing of the shearable fastener.

13. The apparatus as claimed in claim 12 wherein the retainer is comprised of the tubing carrier so that the tubing carrier holds the first tubing string and the second tubing string relative to each other such that when the first tubing string is aligned to be directed into the primary borehole the second tubing string is also aligned to be directed into the secondary borehole.

14. The apparatus as claimed in claim 12 wherein the retainer is comprised of a dual bore packer.

15. The apparatus as claimed in claim 12 further comprising a manifold for inserting in the main borehole to combine the first tubing string and the second tubing string into a third tubing string.

16. The apparatus as claimed in claim 15 wherein the manifold comprises a lower end for connecting with the first tubing string and the second tubing string and an upper end for connecting with the third tubing string and wherein the manifold defines a manifold junction for facilitating communication of the third tubing string with both the first tubing string and the second tubing string.

17. The apparatus as claimed in claim 16 wherein the retainer is comprised of the manifold.

18. The apparatus as claimed in claim 5 wherein the retainer orienting mechanism is comprised of an orienting surface at the upper end of the deflector whereby the lower end of the second tubing string is directed toward the secondary borehole orifice when the lower end of the second tubing string is lowered into engagement with the upper end of the deflector.

19. The apparatus as claimed in claim 18 wherein the upper end of the deflector defines a primary borehole orifice which communicates with the deflector conduit and a secondary borehole orifice which communicates with the secondary borehole, wherein the size of the primary borehole orifice is different than the size of the secondary borehole orifice, and wherein the retainer orienting mechanism is further comprised of the primary borehole orifice and the secondary borehole orifice.

20. The apparatus as claimed in claim 19 wherein the first tubing string comprises a lower end for directing into the primary borehole, wherein the second tubing string comprises a lower end for directing into the secondary borehole, wherein the secondary borehole orifice is larger in size than the primary borehole orifice and wherein the lower end of the second tubing string is sized to fit within the secondary borehole orifice but not to fit within the primary borehole orifice.

21. The apparatus as claimed in claim 20 wherein a constriction is associated with the secondary borehole, wherein the lower end of the second tubing string further comprises a detachable expansion, wherein the lower end of the second tubing string and the expansion are sized such that the lower end of the second tubing string will fit within the secondary borehole orifice with the expansion attached to it, but the lower end of the second tubing string will fit within the constriction only with the expansion detached from it, and wherein the expansion is detachable from the lower end of the second tubing string as the second tubing string is directed into the secondary borehole.

22. The apparatus as claimed in claim 21 wherein a secondary borehole seat is associated with the secondary borehole and wherein the constriction is comprised of the secondary borehole seat.

23. The apparatus as claimed in claim 20 wherein the retainer is comprised of a dual bore packer.

24. The apparatus as claimed in claim 20 further comprising a manifold for inserting in the main borehole to combine the first tubing string and the second tubing string into a third tubing string.

25. The apparatus as claimed in claim 24 wherein the manifold comprises a lower end for connecting with the first tubing string and the second tubing string and an upper end for connecting with the third tubing string and wherein the manifold defines a manifold junction for facilitating communication of the third tubing string with both the first tubing string and the second tubing string.

26. The apparatus as claimed in claim 25 wherein the retainer is comprised of the manifold.

27. In a borehole comprising a main borehole, a primary borehole, a secondary borehole and a borehole junction, wherein the main borehole communicates with both the primary borehole and the secondary borehole at the borehole junction, a method for directing a first object into the primary borehole from the main borehole and directing a second object into the secondary borehole from the main borehole, the method comprising:

(a) positioning in the borehole at the borehole junction a deflector for the purpose of directing the second object into the secondary borehole from the main borehole and for the purpose of facilitating the direction of the first object into the primary borehole, wherein the deflector defines a deflector conduit extending therethrough to facilitate communication between the main borehole and the primary borehole when the deflector is positioned in the borehole at the borehole junction;

(b) inserting into the main borehole the first object, the second object and a retainer for holding the first object and the second object relative to each other such that when the first object is aligned to be directed into the primary borehole the second object is also aligned to be directed into the secondary borehole;

(c) orienting the retainer relative to the borehole junction so that the first object is aligned to be directed into the primary borehole and the second object is aligned to be directed into the secondary borehole; and (d) directing the first object into the primary borehole and directing the second object into the secondary borehole by bringing the first object and the second object into contact with the deflector.

28. The method as claimed in claim 27 wherein the deflector positioning step includes the step of orienting the deflector at the junction so that the second object may be directed into the secondary borehole.

29. The method as claimed in claim 28 wherein the first object is a first tubing string and wherein the second object is a second tubing string.

30. The method as claimed in claim 29 wherein the directing step includes the steps of engaging a lower end of the first tubing string with a deflector seat associated with the deflector conduit and engaging a lower end of the second tubing string with a secondary borehole seat associated with the secondary borehole.

31. The method as claimed in claim 30 wherein the deflector comprises a lower end, wherein the lower end of the deflector further comprises a deflector extension, and wherein the positioning step includes the step of engaging the deflector extension with a primary borehole seat associated with the primary borehole.

32. The method as claimed in claim 30 wherein the first tubing string is directed into the primary borehole before the lower end of the second tubing string becomes engaged with the secondary borehole seat.

33. The method as claimed in claim 32 wherein the lower end of the first tubing string becomes engaged with the deflector seat at substantially the same time that the lower end of the second tubing string becomes engaged with the secondary borehole seat.

34. The method as claimed in claim 27 wherein the retainer orienting step includes the step of engaging an upper end of the deflector with a tubing carrier which holds at least one of the first object and the second object such that orientation of the tubing carrier relative to the deflector causes orientation of the retainer relative to the deflector.

35. The method as claimed in claim 34 wherein the retainer orienting step includes the step of engaging a first surface on the upper end of the deflector with a complementary second surface on the tubing carrier so that the retainer may be oriented relative to the deflector by engagement of the first surface with the second surface.

36. The method as claimed in claim 27 wherein the retainer orienting step includes the step of engaging a lower end of the second object with an orienting surface at an upper end of the deflector.

* * * * *